US008375569B2

(12) United States Patent
Fukui et al.

(10) Patent No.: US 8,375,569 B2
(45) Date of Patent: Feb. 19, 2013

(54) APPARATUS FOR MANUFACTURING A TRANSFORMER CORE

(75) Inventors: Kazuyuki Fukui, Tainai (JP); Kenji Nakanoue, Tainai (JP); Takashi Kurata, Sekikawa (JP); Hisashi Koyama, Tainai (JP); Hidemasa Yamaguchi, Tainai (JP); Chikara Mizusawa, Murakami (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 12/863,931

(22) PCT Filed: Jun. 11, 2009

(86) PCT No.: PCT/JP2009/002642

§ 371 (c)(1),
(2), (4) Date: Oct. 11, 2010

(87) PCT Pub. No.: WO2009/150842

PCT Pub. Date: Dec. 17, 2009

(65) Prior Publication Data

US 2011/0018674 A1 Jan. 27, 2011

(30) Foreign Application Priority Data

Jun. 13, 2008 (JP) ..... 2008-154951
Jun. 8, 2009 (JP) ..... 2009-136803

(51) Int. Cl.
*H01F 41/02* (2006.01)

(52) U.S. Cl. ..... 29/738; 29/564.6; 29/609; 242/437.3

(58) Field of Classification Search ..... 29/602.1; 336/221; 242/437.3
See application file for complete search history.

(56) References Cited

U.S. PATENT DOCUMENTS

| | | | | |
|---|---|---|---|---|
| 4,413,406 | A * | 11/1983 | Bennett et al. | 29/609 |
| 5,261,152 | A | 11/1993 | Simozaki et al. | |
| 5,309,627 | A * | 5/1994 | Burrage et al. | 29/738 |
| 6,615,482 | B2 * | 9/2003 | Rand | 29/602.1 |
| 2011/0018674 | A1 * | 1/2011 | Fukui et al. | 336/221 |

FOREIGN PATENT DOCUMENTS

| | | |
|---|---|---|
| JP | 35-003712 | 4/1935 |
| JP | 64-002309 | 1/1989 |
| JP | 04-302114 | 10/1992 |
| JP | 07-066064 | 3/1995 |
| JP | 08-162350 | 6/1996 |

(Continued)

*Primary Examiner* — Minh Trinh
(74) *Attorney, Agent, or Firm* — McDermott Will & Emery LLP

(57) ABSTRACT

An apparatus for manufacturing a transformer core includes a drawing which draws magnetic sheet materials in parallel from winding bodies. A cutter cuts the sheet materials at predetermined positions substantially simultaneously to form sheets each with a different length. An overlapping unit forms a block-shaped laminate by laminating the cut magnetic sheet materials in length and forms a resultant laminate by laminating the formed block-shaped laminates. An annulation unit forms an annular structure of the resultant laminate so that the longer block-shaped laminate forms the outer annular portion and the shorter block-shaped laminate forms the inner annular portion. Both ends of the magnetic sheet materials are abutted or overlapped to locate the abutted or overlapped portions at annularly different positions between adjoining layers of the magnetic sheet materials. A control unit controls the drawing unit, cutter and overlapping unit.

8 Claims, 16 Drawing Sheets

FOREIGN PATENT DOCUMENTS

| | | |
|---|---|---|
| JP | 09-237727 | 9/1997 |
| JP | 10-199742 | 7/1998 |
| JP | 10-241980 | 9/1998 |
| JP | 2002-160120 | 6/2002 |
| JP | 2005-161399 | 6/2005 |
| JP | 2005-211928 | 8/2005 |
| JP | 2006-093366 | 4/2006 |
| JP | 2006-173449 | 6/2006 |
| JP | 2007-180135 | 7/2007 |

* cited by examiner

MEASURED LAMINATE THICKNESS: $T_1$ MASS AVERAGE PLATE THICKNESS: $t_1$
NUMBER OF LAMINATED SHEETS: n EFFECTIVE LAMINATE THICKNESS: $T_2$
EFFECTIVE SPACE FACTOR: $LF_1$ STANDARD SPACE FACTOR: $LF_2$
CORRECTION COEFFICIENT: $K_{LF}$ CORRECTION FEED AMOUNT: $L_1$
STANDARD FEED AMOUNT: $L_2$

APPARATUS FOR MANUFACTURING A TRANSFORMER CORE

RELATED APPLICATIONS

This application is the U.S. National Phase under 35 U.S.C. §371 of International Application No. PCT/JP2009/002642, filed on Jun. 11, 2009, which in turn claims the benefit of Japanese Application No. 2008-154951, filed on Jun. 13, 2008 and Japanese Application No. 2009-136803, filed Jun. 8, 2009, the disclosures of which Applications are incorporated by reference herein.

TECHNICAL FIELD

The present invention relates to a structure of a transformer wound core formed by laminating thin magnetic metals, and technology of manufacturing the same.

BACKGROUND ART

Patent Documents, for example, JP-A Nos. H8-162350 (Patent Document 1) and 4-302114 (Patent Document 2) disclose the related art of the present invention. JP-A No. H8-162350 discloses the technology for manufacturing a transformer amorphous metal, which is capable of improving the product property by drawing plural sheet materials in laminated state from rolled amorphous metals from plural uncoiler devices, cutting the plural sheets simultaneously while changing the cutting lengths for each block of the laminated sheet materials by an amount set to $2\pi t$ or the amount approximate to $2\pi t$, and making the gap between joint portions substantially constant when forming the material into the rectangular shape. JP-A No. H4-302114 discloses the technology for manufacturing the amorphous core which exhibits excellent magnetic property, and is suitable for simplifying manufacturing steps and reducing the facility cost by continuously feeding the sheet block obtained by laminating the sheet material as tight laminated amorphous metals through aligning the rolled plural reels in series, and the sheet material as tight laminated amorphous metals derived from aligning the other plural reels in series, cutting the block into the predetermined length, positioning the cut sheet block, winding the sheet block around the winding core sequentially to form the rectangular core while forming the block into the rectangular shape, and annealing the core in the magnetic field.

The apparatus and method for manufacturing the transformer core will be described referring to an apparatus and a method for cutting the magnetic material.

JP-A No. H10-241980 (Patent Document 3) which discloses related art of the present invention is structured to suppress variation in the material by feeding laminated plural sheets to the cutting device influenced, thus cutting the material with unnecessarily long length. As a result, the abutting portion of the winding core has deteriorated shape, deteriorated characteristics, and the material is fed to the joint portion which does not require such material. Reduction in the cross-section area of the core may also cause deteriorated property in the end.

PRIOR ART

Patent Document

Patent Document 1: JP-A No. H8-162350
Patent Document 2: JP-A No. H4-302114
Patent Document 3: JP-A No. H10-241980

SUMMARY OF THE INVENTION

Problems to be Solved by the Invention

In the above-described related art, the amorphous metals drawn from the plural rolls are laminated to form a laminate metal so as to be cut to a predetermined length. The cut metals are formed into a rectangular shape to fabricate an amorphous metal core. The length of gap between both ends of each of the respective amorphous metals at the joint portion resulting from formation of the rectangular shape, the lap length at both ends (length of the portion where both ends are overlapped), and the lap position (position at which both ends are overlapped) are determined depending on the cutting length of the laminate sheet material. Even in the single overlapping sheet material, such value derived from the material at the outer circumference of the rectangular core is different from the one derived from the sheet material on the inner circumference, which may cause variation in the gap length or the lap length, thus influencing and changing the magnetic circuit properties and dimensions of the core. In case of variation in the cutting length of the laminate sheet material by itself, the gap length, the lap length, and the lap position at the joint portion may further be dispersed. This may largely change the magnetic circuit properties of the core, that is, iron loss and magnetic resistance, and dimension of the core, that is, the laminate layer thickness at the joint portion.

In consideration of the aforementioned technical circumstances, the present invention aims at suppressing variation in the magnetic circuit property and dimension of the transformer core with laminate structure as well as improving productivity.

It is impractical to use measured thickness of the laminated plural amorphous metals, which has been cut for feedback of the cutting length. In the present invention, the thickness is estimated using the other means rather than the use of the measured thickness so as to suppress variation in the material including adjustment of the cutting length, and to stabilize the product property. The present invention is further intended to improve performance of the core as a whole.

Meanwhile, the material feeding structure during cutting is reviewed to propose the structure for further improving accuracy of the material feeding especially after the cutting operation as described above.

Means for Solving the Problems

The present invention is capable of establishing the aforementioned object by solving the aforementioned problem.

Specifically, the present invention provides the transformer core with laminate structure formed by laminating plural thin strip-shaped magnetic material sheets each with different length, and forming an annular shape such that abutting portions or overlapped portions between the leading end surface and the terminal end surface of the respective layers of the magnetic materials in the longitudinal direction are located at circumferentially different positions of the core between adjoining layers. In the technology for manufacturing the transformer core with laminate structure, the thin magnetic materials are drawn from plural winding bodies each having the thin magnetic sheet wound like hoop in parallel, the materials are simultaneously cut at the respective predetermined positions to provide plural thin magnetic materials each with different length, a block-shaped laminate is formed by laminating the plural magnetic materials in the order of length, the block-shaped laminates are further laminated in the order of length such that the longer block is wound on the outer circumference of a winding core and the shorter block is wound on the inner circumference of the winding core, both ends of the respective magnetic materials are abutted or overlapped in the respective blocks to form an annular structure such that the abutted portion or the overlapped portion is located at circumferentially different positions between the adjoining magnetic material layers. In the technology for manufacturing the transformer core with the laminate structure, the thin magnetic materials are drawn from plural winding bodies each having the thin magnetic sheet wound like hoop in parallel, the materials are simultaneously cut at the respective predetermined positions to provide plural thin magnetic materials each with different length, the plural magnetic materials are laminated in the order of length such that one end surfaces of the respective materials are aligned in the longitudinal direction, and the other end surfaces are displaced with one another, or both end surfaces are displaced to form the block-shaped laminates, the block-shaped laminate is bent at predetermined curvature such that the longer magnetic material is located on the outer circumference, and the shorter magnetic material is located on the inner circumference. The block-shaped laminate is unbent again to adjust the relative displacement amount of the plural magnetic materials to a predetermined amount. The block-shaped laminates each formed of the plural magnetic materials having the displacement amount adjusted are laminated in the order of length such that the longer block-like laminate is wound on the outer circumference of the winding core, and the shorter block-like laminate is wound on the inner circumference. Both ends of the respective magnetic materials are abutted or overlapped to form an annular structure such that the abutted portions or the overlapped portions are located at circumferentially different positions between the adjoining magnetic material layers.

The preset invention employs a score sheet (millsheet data) of a manufacturer attached to the amorphous metal upon its delivery as solution for suppressing variation of the product. The score sheet contains data of the mass average thickness and space factor obtained by measuring the width and mass of the material with the predetermined length. The correction value upon cutting is estimated using the average values of thickness and space factor of the hoop material derived from the score sheet so as to improve accuracy.

The amorphous metal is cut to calculate the mass average thickness $t_1$ using the cutting length by the predetermined number of sheets (for example, 1000 sheets) and measured mass. In the laminating process, the thickness $T_1$ by the predetermined number of sheets under the constant load is measured, and the laminate thickness $T_2$ is calculated using the mass average thickness $t_1$ and the number of cut sheets n. A measured space factor $LF_1$ is calculated by obtaining the difference between the calculated laminate thickness $T_2$ and the measured laminate thickness $T_1$. The standard space factor $LF_2$ is preliminarily set to change the correction value $K_{LF}$ in accordance with the deviation ratio with respect to the measured space factor so as to be used for feedback to the cutting length.

In the present invention, the material to be fed is angled to have a V-shape, or an inverted V-shape as the solution for stabilizing high accuracy of the material feeding mechanism. The tray for receiving the fed material is provided with a belt conveyor mechanism or combination thereof. The material is kept spaced above the tray with air for the purpose of reducing friction between the fed material and the receiving tray. As the cutting length is increased, the feeding speed is controlled to be reduced, thus improving the feeding accuracy.

ADVANTAGEOUS EFFECTS OF THE INVENTION

The transformer core with laminated structure is capable of suppressing fluctuation in the magnetic circuit property and dimension, and improving the productivity. As a result, this makes it possible to reduce the cost for manufacturing the transformer core.

In the related art, measurement of the plate thickness which is difficult to be executed with accuracy requires correction of the cutting length for alleviating fluctuation of the material. However in the present invention, the mass average plate thickness close to the measured value may be obtained to suppress fluctuation in the material and stabilize the product property.

The material feeding mechanism has been examined to enable further improvement of the form shaping accuracy.

MODE FOR CARRYING OUT THE INVENTION

Figure 1:
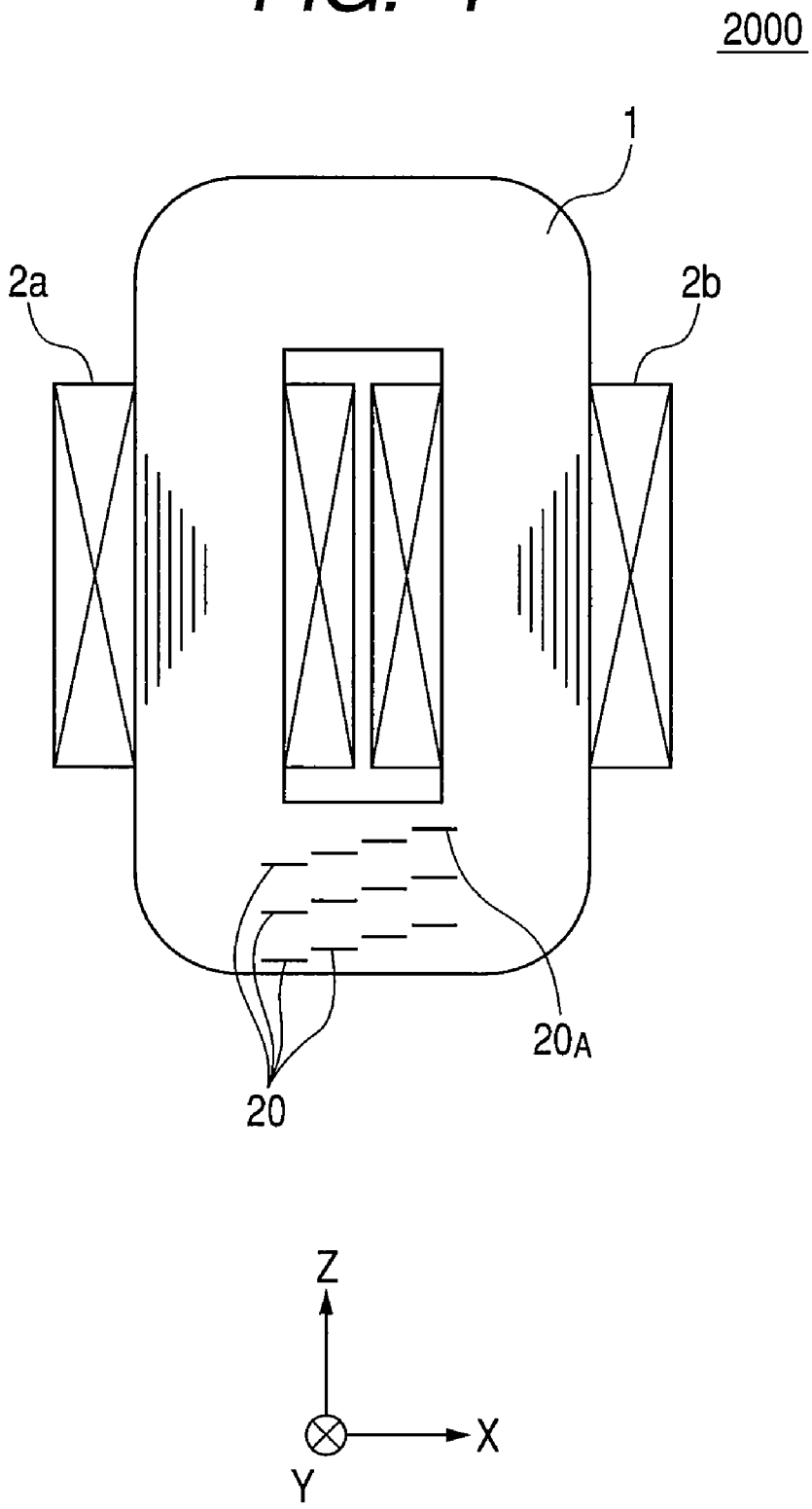
FIG. 1 illustrates an exemplary structure of a transformer using a transformer core to which the manufacturing technology of the present invention is applied.

An embodiment of the present invention will be described referring to the drawings.

Figure 2:
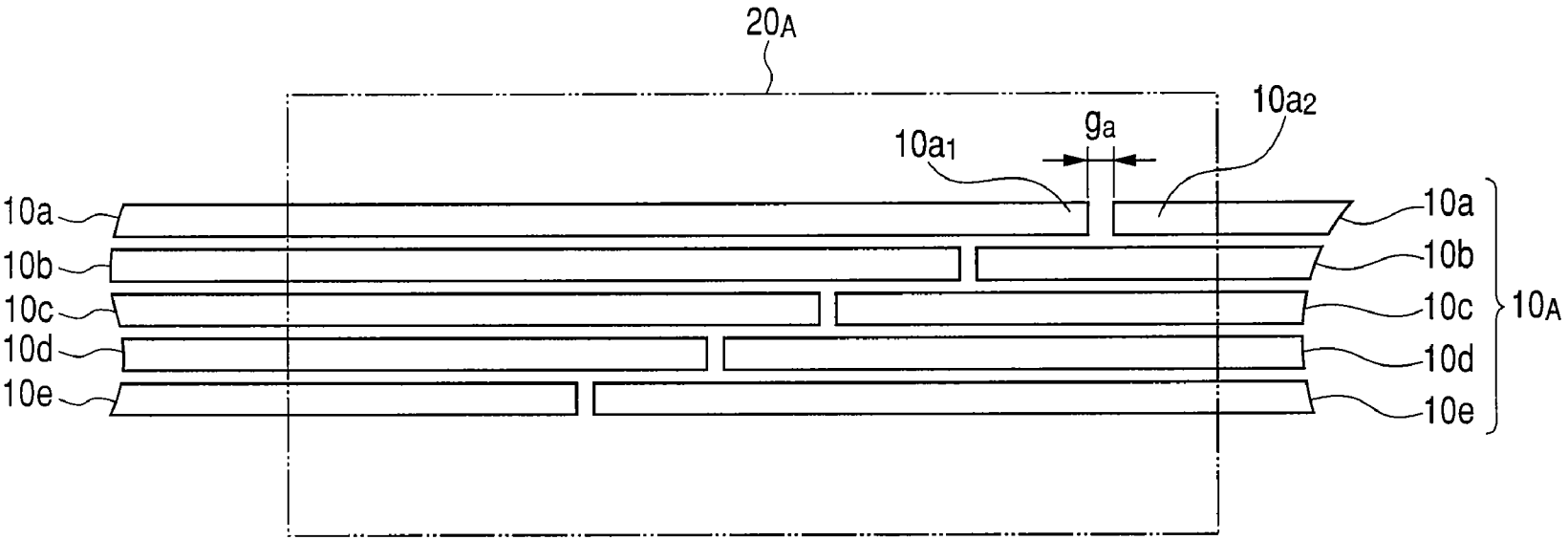
FIG. 2 is an explanatory view of a joint portion of a magnetic material of the transformer core according to the manufacturing technology of the present invention.
Figure 3:
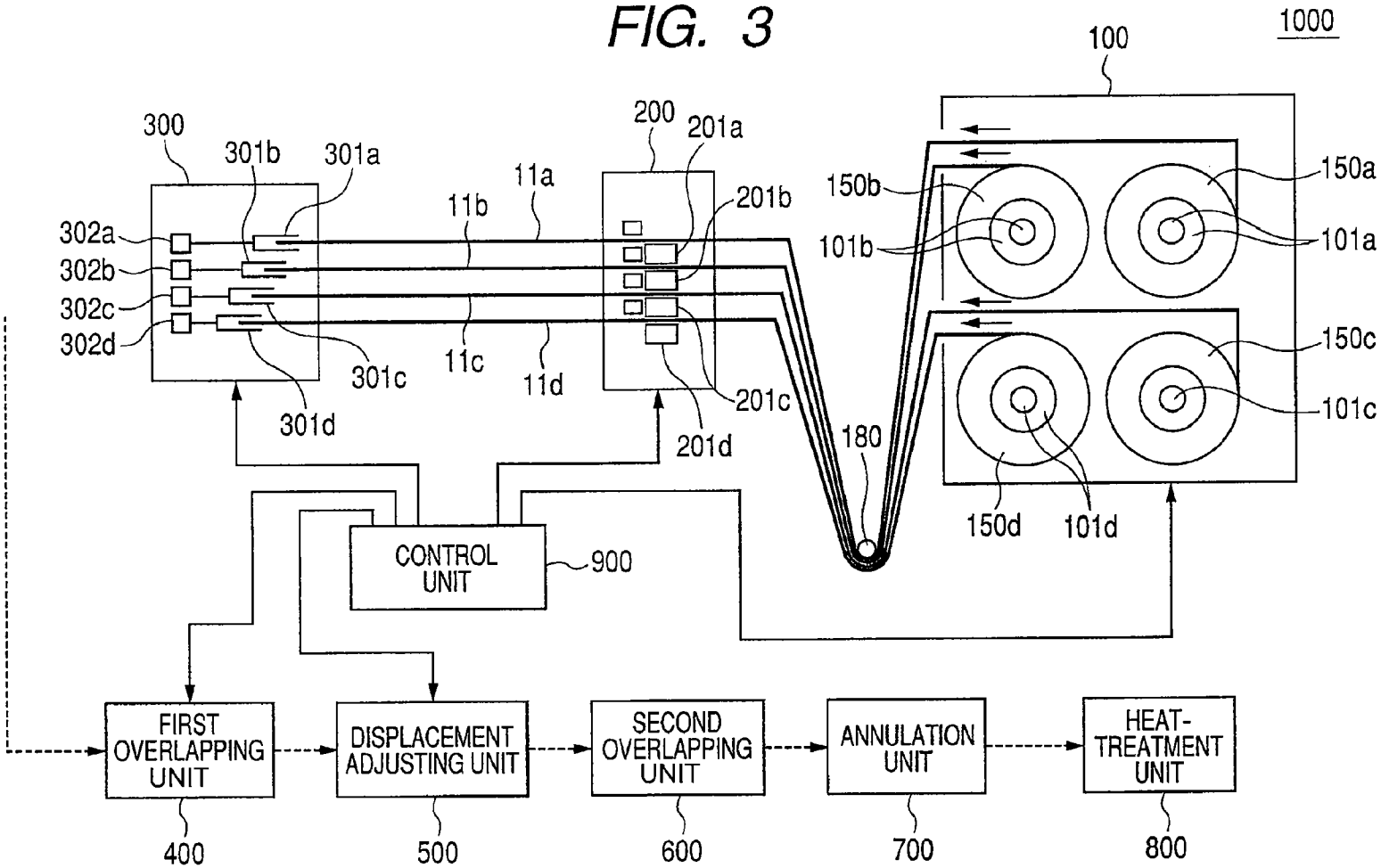
FIG. 3 illustrates an exemplary structure of an apparatus for manufacturing the transformer core according to the present invention.
Figure 4:
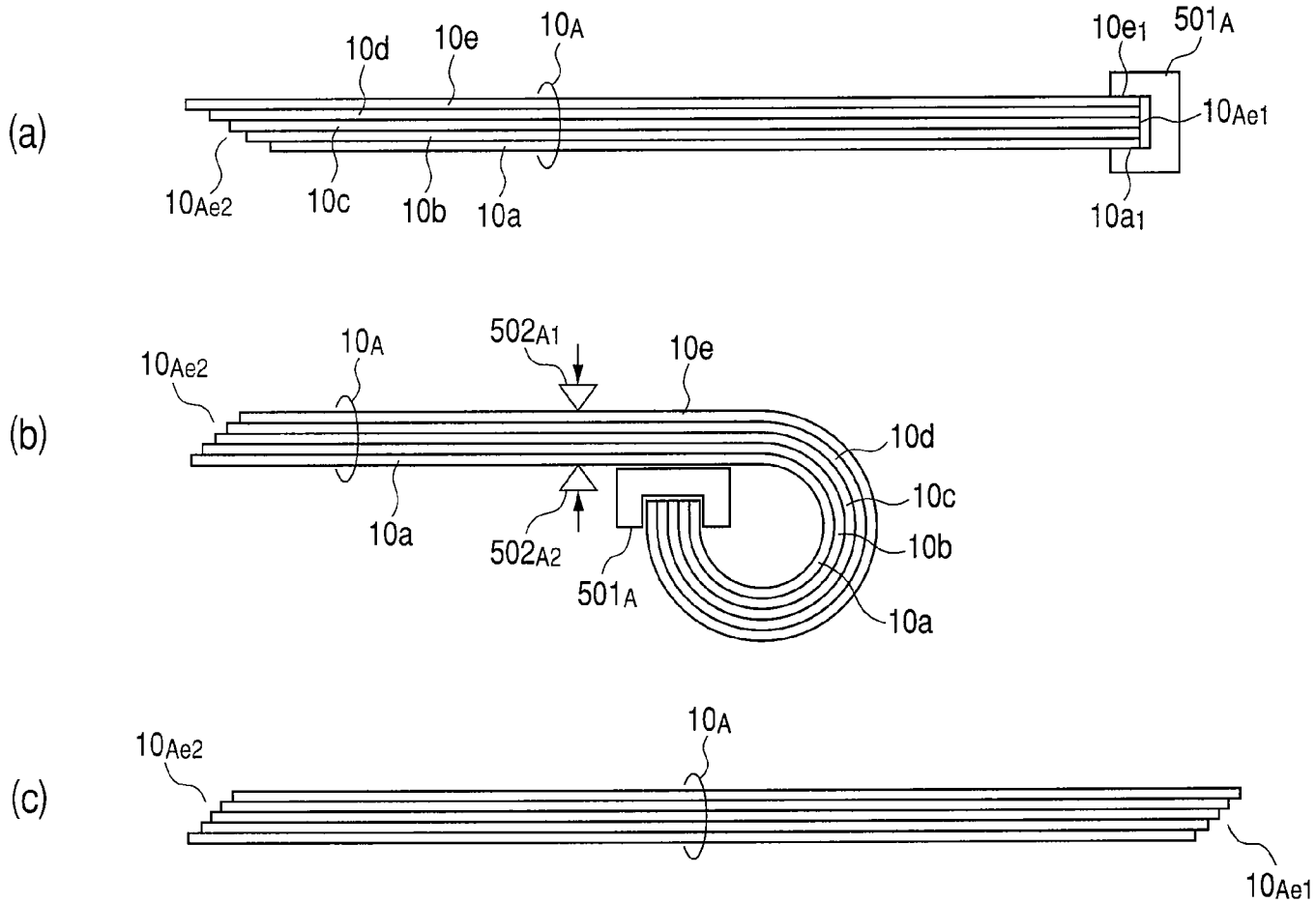
FIG. 4 is an explanatory view of a displacement adjusting unit of the apparatus for manufacturing the transformer core shown in FIG. 3.
Figure 5:
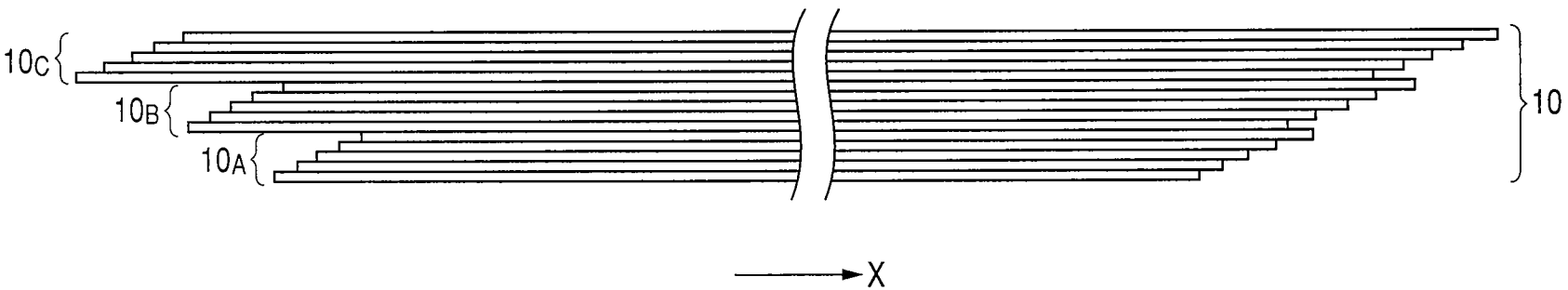
FIG. 5 is an explanatory view of a second overlapping unit of the apparatus for manufacturing the transformer core shown in FIG. 3.
Figure 6:
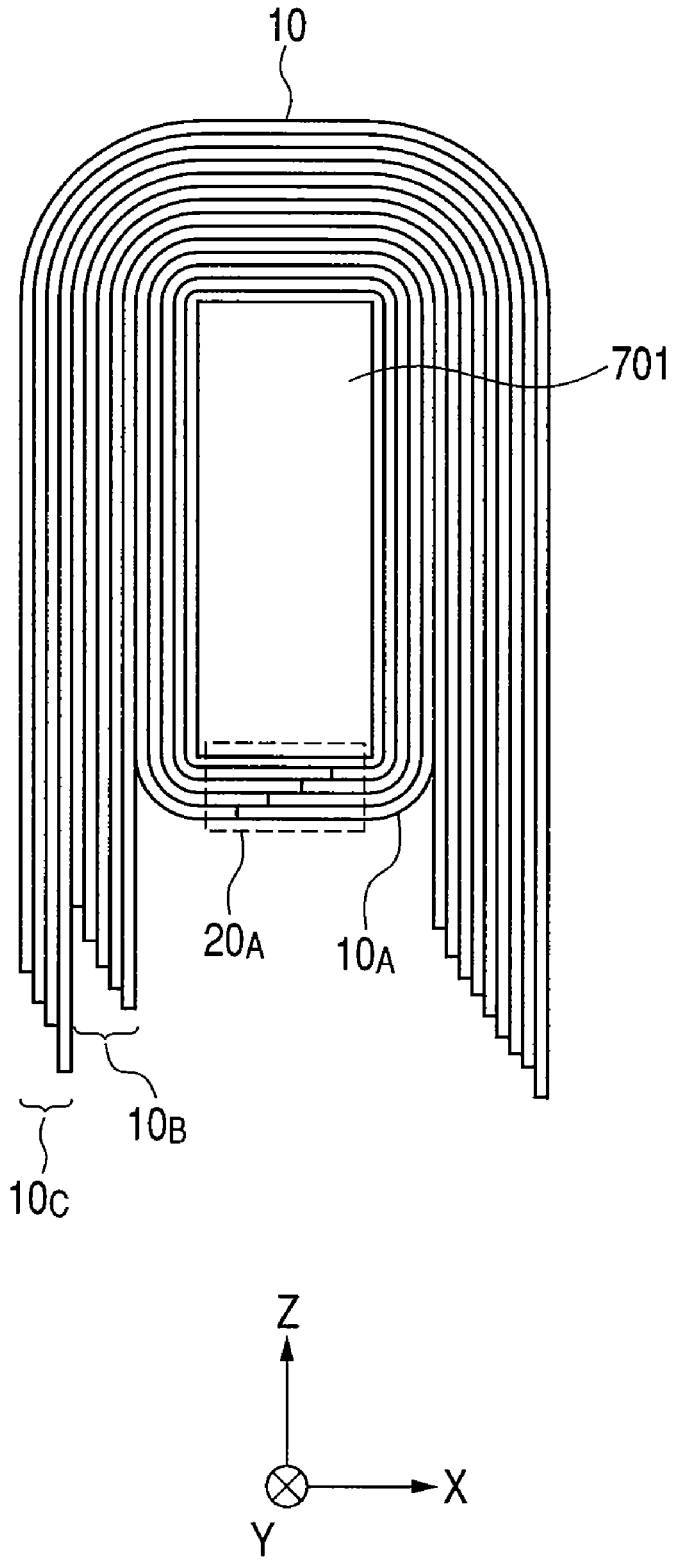
FIG. 6 is an explanatory view of an annulation unit of the apparatus for manufacturing the transformer core shown in FIG. 3.
Figure 7:
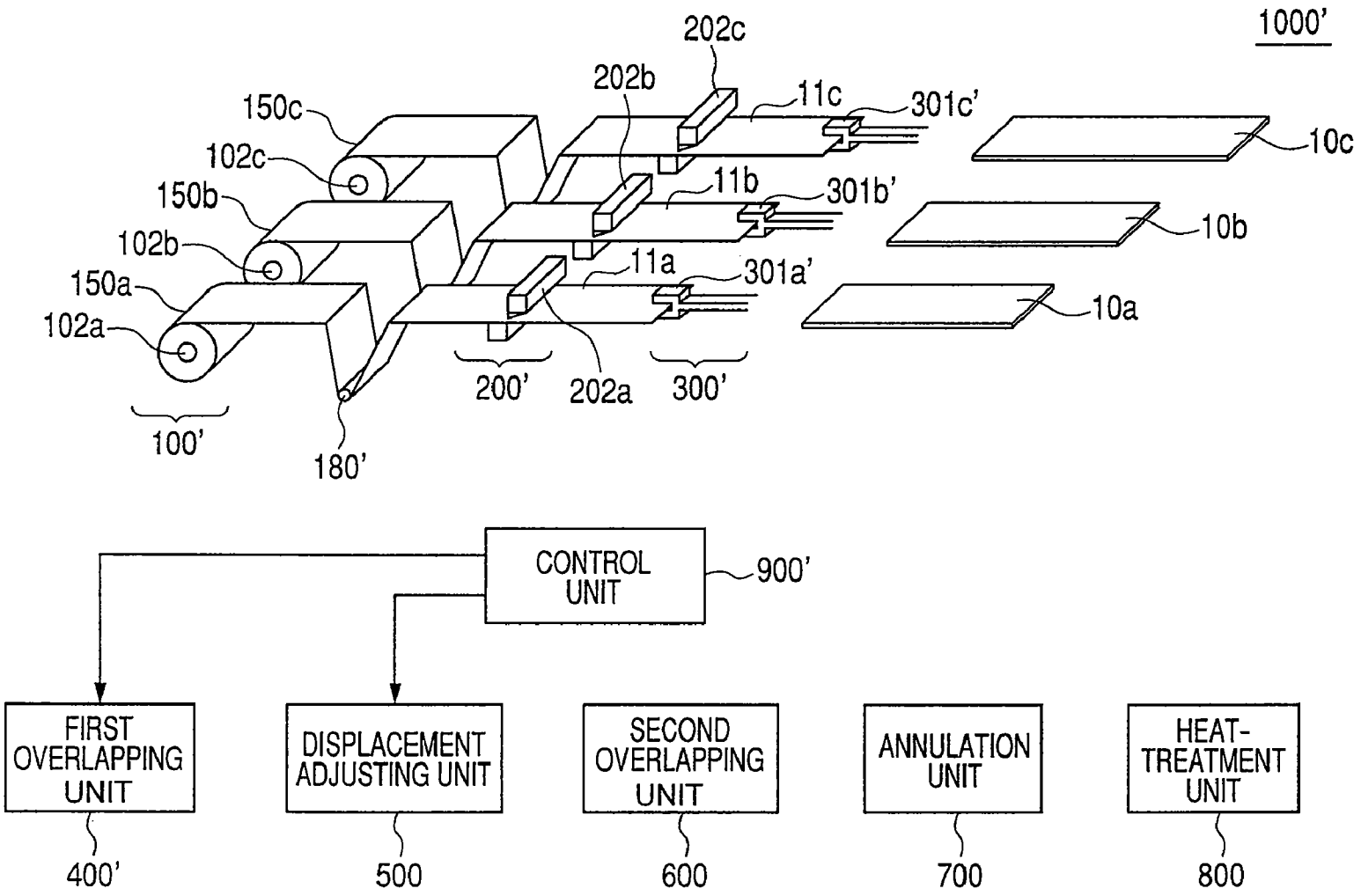
FIG. 7 illustrates another exemplary structure of the apparatus for manufacturing the transformer core according to the present invention.

FIGS. 1 to 7 are explanatory views of the embodiment according to the present invention. FIG. 1 is a view illustrating an exemplary structure of a transformer using a transformer core to which the manufacturing technology according to the preset invention is applied. FIG. 2 is an explanatory view of the joint portion of the magnetic material for forming the transformer core manufactured by the technology according to the present invention. FIG. 3 is a view illustrating a structure of an apparatus for manufacturing the transformer core according to the present invention. FIG. 4 is an explanatory view of a displacement adjusting unit of the apparatus for manufacturing the transformer core shown in FIG. 3. FIG. 5 is an explanatory view of a second overlapping unit of the apparatus for manufacturing the transformer core shown in FIG. 3. FIG. 6 is an explanatory view of an annulation unit of the apparatus for manufacturing the transformer core shown in FIG. 3. FIG. 7 is a view illustrating another exemplary structure of the apparatus for manufacturing the transformer core.

Referring to FIG. 1, a reference numeral 2000 denotes a transformer, and 1 denotes an annular core formed by laminating plural amorphous metals (hereinafter referred to as an amorphous metal), each of which is a thin magnetic sheet material with its width of approximately 25 μm to constitute a magnetic circuit of the transformer 2000. Reference numerals 2*a*, 2*b* denote coils for exciting the core 1, and 20 denotes each joint portion formed by a laminate as a block (hereinafter referred to as a block-shaped laminate) derived from laminating plural amorphous metals. A reference numeral $\mathbf{20}_A$ denotes one of the joint portions 20. Adjoining joint portions of the plural joint portions 20, which are displaced with each other in the core thickness direction (+/−Z-axis direction) are arranged at circumferentially different positions of the core 1 (+/−X-axis direction shown in FIG. 1). In each of the joint portions 20, the joints of the respective amorphous metals, that is, those between the leading end and the terminal end of the single amorphous metal (respective amorphous metals) are located at circumferentially different positions between the adjoining sheet materials with respect to the core 1 (+/−X-axis direction).

The components of the structure shown in FIG. 1 will be designated with the same reference numerals of FIG. 1.

FIG. 2 illustrates a state inside the joint portion $\mathbf{20}_A$ of the single block-shaped laminate which constitutes the core 1 shown in FIG. 1.

Referring to FIG. 2, a reference numeral $\mathbf{10}_A$ denotes the block-shaped laminate, 10*a* to 10*e* denote amorphous metals each with thickness of approximately $0.025\times10^{-3}$ m for constituting the block-shaped laminate $\mathbf{10}_A$. A reference numeral $\mathbf{10}a_1$ denotes a leading end of the amorphous metal 10*a*, $\mathbf{10}a_2$ denotes a terminal end of the amorphous metal 10*a*, and $g_a$ denotes a gap defined by the leading end $\mathbf{10}a_1$ and the terminal end $\mathbf{10}a_2$. Referring to the structure shown in FIG. 2, the surface of the leading end (leading end surface) and the surface of the terminal end (terminal end surface) of each of the respective amorphous metals 10*a* to 10*e* are abutted while being oppositely disposed with respect to the gap therebetween. The gap may be set to a small value or zero to suppress increase in the magnetic resistance and leakage of the magnetic flux in the magnetic circuit formed by the respective amorphous metals. The portion where the leading end surface and the terminal end surface of the amorphous metal are abutted will be referred to as an abutting portion. The amorphous metals 10*a* to 10*e* of the block-shaped laminate $\mathbf{10}_A$ have different values of length. The amorphous metals 10*a*, 10*b*, 10*c*, 10*d*, and 10*e* are laminated in the order of length such that the shortest amorphous metal 10*a* is located at the inner circumference of the annular core 1, and the longest amorphous metal 10*e* is located at the outer circumference. According to the present invention, each of the amorphous metals 10*a* to 10*e* may have both ends overlapped with each other such that the leading end and the terminal end of the respective sheet materials are overlapped (lap). In the aforementioned case, the portion where such ends are overlapped will be referred to as the overlapped portion.

The components of the structure described referring to FIG. 2 will be designated with the same reference numerals of FIG. 2.

FIG. 3 illustrates an exemplary structure of the apparatus for manufacturing the transformer core according to the present invention. The exemplary structure shows that the orthographic projections on the plan view of plural thin magnetic materials drawn from the plural winding bodies are overlapped with one another.

Referring to FIG. 3, a reference numeral 1000 denotes an apparatus for manufacturing a transformer core 1, 100 denotes a winding body support portion as support means for supporting the plural winding bodies each formed by winding the thin amorphous metal as the magnetic material with thickness of approximately 25 μm into hoop, 150*a* to 150*d* denote winding bodies each formed by winding the thin amorphous metal with thickness of approximately $0.025\times10^{-3}$ m into hoop, 101*a* to 101*d* denote reel portions for rotatably supporting the winding bodies 150*a* to 150*d*, respectively, 11*a* to 11*d* denote the amorphous metals drawn from the winding bodies 150*a* to 150*d*, 180 denotes a roller which abuts on the drawn amorphous metals 11*a* to 11*d*, and applies tensional force thereto, 200 denotes cutting means for cutting the drawn plural amorphous metals 11*a* to 11*d* at predetermined set positions simultaneously to provide the plural thin amorphous metals each with different length, 201*a* to 201*d* denote cutter portions for cutting the amorphous metals 11*a* to 11*d* in the cutting means 200 to provide strip-shaped amorphous metals, 300 denotes a drawing portion as drawing means for drawing the amorphous metals 11*a* to 11*d* from the plural winding bodies 150*a* to 150*d* by the preset values of the length, respectively, 301*a* to 301*d* denote grip portions for gripping each leading end of the amorphous metals 11*a* to 11*d* in the drawing portion 300, 302*a* to 302*d* denote driving portions for driving and displacing the respective grip portions 301*a* to 301*d* in the direction where the amorphous metals 11*a* to 11*d* are drawn in the drawing portion 300, 400 denotes a first overlapping unit as first overlapping means for forming the block-shaped laminate by laminating the thus cut plural strip-shaped amorphous metals in the order of length (overlapping) in the state where one end surfaces (leading end surface or terminal end surface) of the material are aligned in the longitudinal direction with one another while displacing the other terminal ends (rear end surface or the leading end surface) with one another, or the end surfaces of the respective end portions (leading end surface and rear end surface) are displaced, 500 denotes a displacement adjusting unit as displacement adjusting means for adjusting a relative displacement amount of the plural amorphous metals in the thus formed block-shaped laminate, that is, the displacement amount of the respective positions of the leading end surface and the terminal end surface of the amorphous metal to a preset amount, 600 denotes a second overlapping unit as second overlapping means for laminating the plural block-shaped laminates having the displacement adjusted in the order of length, 700 denotes an annulation unit as annulation means for forming an annular structure by winding the laminate formed by laminating the plural block-shaped laminates such that the longer block-shaped layer is wound on the outer circumference of the wiring core and the shorter block-shaped laminate layer is wound on the inner circumference, abutting or overlapping both end portions of the respective amorphous metals such that the abutting or overlapped portions are located at circumferentially different positions between the adjoining amorphous metal layers, 900 denotes a control unit for controlling the winding body support portion 100, the cutting means 200, the drawing unit 300, the first overlapping unit 400, the displacement adjusting unit 500, and the second overlapping unit 600, 800 denotes a heat-treatment unit for subjecting the annular laminate (formed of plural block-shaped laminates) to the heat-treatment by heating at the predetermined temperature for a predetermined time. Referring to FIG. 3, the apparatus 1000 for manufacturing the core 1 is provided with the wiring body support portion 100, the cutting means 200, the drawing portion 300, the first overlapping unit 400, the displacement adjusting unit 500, the second overlapping unit 600, the annulation unit and the control unit 900, respectively.

The displacement adjusting unit 500 allows the end fixing portion to push surfaces of one ends of two outermost amorphous metals among those for forming the block-shaped laminate to apply compression force to the block-shaped laminate in the laminating direction. In the state where the end portion of the block-shaped laminate is kept fixed, the end fixing portion is displaced with the bent portion, and the block-shaped laminate is bent at the predetermined curvature such that the longer amorphous metal is located at the outer circumference side, and the shorter amorphous metal is located at the inner circumference side. The compression force is applied to the intermediate portion of the laminate in the longitudinal direction of the thus bent block-shaped laminate by an intermediate fixing portion. Thereafter, the end of the laminate fixed by the end fixing portion is released while applying the compression force to the laminate with the intermediate fixing portion. Then the end fixing portion is displaced to reduce the curvature for bending the laminate so as to adjust the relative displacement amount of the plural amorphous metals in the laminate to the preset amount.

Referring to the structure shown in FIG. 3, the core 1 is manufactured by executing following process steps.

(1) The drawing portion 300 draws the amorphous metals by the respective predetermined amounts from plural winding bodies 150*a* to 150*d* each formed by winding the amorphous metal into hoop.

(2) The thus drawn plural amorphous metals are substantially simultaneously cut at the predetermined positions by the cutting means 200 to provide plural thin amorphous metals each with different length.

(3) The first overlapping unit 400 laminates the cut plural amorphous metals in the order of length, aligning one end surfaces of those sheet materials in the longitudinal direction such that the other end surfaces are displaced with one another. Alternatively, the block-shaped laminate may be structured to have both end surfaces of the respective amorphous metals displaced.

(4) The displacement adjusting unit 500 pushes one end surfaces of two outermost amorphous metals of those for forming the block-shaped laminate to apply compression force to the block-shaped laminate in the laminating direction of the amorphous metal so as to fix the end of the block-shaped laminate with the end fixing portion.

(5) The displacement adjusting unit 500 displaces the end fixing portion to bend the block-shaped laminate at the predetermined curvature such that the longer amorphous metal is located at the outer circumference side, and the shorter amorphous metal is located at the inner circumference side.

(6) The displacement adjusting unit 500 allows the intermediate fixing portion to apply the compression force to the intermediate portion of the thus bent block-shaped laminate in the laminating direction of the magnetic material.

(7) The displacement adjusting unit 500 releases the end of the block-shaped laminate, which is fixed by the end fixing portion while keeping the block-shaped laminate under the compression force applied by the intermediate fixing portion. The end fixing portion is displaced to reduce the curvature of the block-shaped laminate to adjust the relative displacement amount of the plural amorphous metals in the block-shaped laminate to the predetermined amount.

(8) The second overlapping unit 600 laminates the plural block-shaped laminates each having the displacement amount adjusted in the order of length.

(9) The annulation unit 700 makes the laminate formed by laminating the plural block-shaped laminates into an annular structure by winding the longer block-shaped laminate on the outer circumference, and the shorter block-shaped laminate on the inner circumference, and abutting or overlapping both ends of the respective amorphous metals such that the abutting or overlapped portions are located at circumferentially different positions between the adjoining amorphous metal layers.

(10) The thus annular laminated body is subjected to the heat treatment at the predetermined temperature for a predetermined time by the heat-treatment unit 800 in the magnetic field.

The components which constitute the structure described referring to FIG. 3 will be designated with the same reference numerals of FIG. 3.

FIG. 4 is an explanatory view of the displacement adjusting unit 500 of the manufacturing apparatus 1000 shown in FIG. 3.

Referring to FIG. 4, a reference numeral $\mathbf{501}_A$ denotes an end fixing portion for pushing surfaces at one ends $\mathbf{10}a_1$, $\mathbf{10}e_1$ of two outermost amorphous metals 10*a*, 10*e* of the block-shaped laminate $\mathbf{10}_A$ formed by laminating the amorphous metals 10*a* to 10*e* each with thickness of approximately $0.025\times10^{-3}$ m, applying the compression force to the block-shaped laminate in the laminating direction of the amorphous metal, and fixing the end portion of the block-shaped laminate in the displacement adjusting unit 500. Reference numerals $\mathbf{502}_{A1}$, $\mathbf{502}_{A2}$ denote the intermediate fixing portions, each of which applies the compression force to the block-shaped laminate $\mathbf{10}_A$ in the direction where the amorphous metals are laminated at the intermediate portion thereof in the longitudinal direction, and a reference numeral $\mathbf{10}_{Ae1}$ denotes an end surface of the block-shaped laminate $\mathbf{10}_A$, which is fixed by the end fixing portion $\mathbf{501}_A$, and $\mathbf{10}_{Ae2}$ denotes the other end surface of the block-shaped laminate $\mathbf{10}_A$.

FIG. 4(*a*) illustrates the block-shaped laminate $\mathbf{10}_A$, which is formed by laminating the amorphous metals 10*a* to 10*e* in the order of length (in the order of longer length: 10*e*, 10*d*, 10*c*, 10*b*, 10*a*, or in the order of shorter length: 10*a*, 10*b*, 10*c*, 10*d*, 10*e*), and aligning one end surfaces $\mathbf{10}_{Ae1}$ while displacing the other end surfaces $\mathbf{10}_{Ae2}$ when end portions of the end surfaces $\mathbf{10}_{Ae1}$ are fixed with the end fixing portion $\mathbf{501}_A$. FIG. 4(*b*) illustrates that the end fixing portion $\mathbf{501}_A$ is displaced such that the block-shaped laminate $\mathbf{10}_A$ is bent at the predetermined curvature to locate the longer amorphous metal 10*e* at the outer circumference, and the shorter amorphous metal 10*a* at the inner circumference, and the intermediate fixing portions $\mathbf{502}_{A1}$ and $\mathbf{502}_{A2}$ apply the compression force to the block-shaped laminate $\mathbf{10}_A$ at the intermediate portion (intermediate position between both ends) in the longitudinal direction of the bent block-shaped laminate $\mathbf{10}_A$. FIG. 4(*c*) illustrates that the end portions of the block-shaped laminate $\mathbf{10}_A$ fixed by the end fixing portion $\mathbf{501}_A$ are released while keeping the compression force to the block-shaped laminate $\mathbf{10}_A$ by the intermediate fixing portions $\mathbf{502}_{A1}$ and $\mathbf{502}_{A2}$, and the end fixing portion $\mathbf{501}_A$ is displaced toward the direction to reduce the curvature of the block-shaped laminate $\mathbf{10}_A$ to eliminate the bent portion thereof into straight so as to adjust the relative displacement amount of the plural amorphous metals 10*a* to 10*e* in the block-shaped laminate $\mathbf{10}_A$ to the predetermined amount. In the state shown in FIG. 4(*b*), the curvature radius of the amorphous metal 10*e* resulting from the bending is maximized, and it is pulled to the largest degree through the bending operation to make the largest moves (displacement) at the end surface in $\mathbf{10}_{Ae1}$, and the curvature radius of the amorphous metal member 10*a* resulting from the bending is minimized, and it is pulled to the least degree through the bending operation to make the smallest move (displacement). After the displacement, the intermediate fixing portions $\mathbf{502}_{A1}$, $\mathbf{502}_{A2}$ keep the amorphous metals 10*a* to 10*e* relatively displaced. In the state where the block-shaped laminate $\mathbf{10}_A$ returns to be straight as shown in FIG. 4(*c*), displacement occurs at the side of the end surface $\mathbf{10}_{Ae1}$. That is, the displacement at the side of the end surface $\mathbf{10}_{Ae2}$ shown in FIG. 4(*a*) is parted to the sides of the end surfaces $\mathbf{10}_{Ae1}$ and $\mathbf{10}_{Ae2}$ as shown in FIG. 4(*c*) after the bending operation as shown in FIG. 4(*b*).

The components of the structure described referring to FIG. 4 will be designated with the same reference numerals of FIG. 4.

FIG. 5 is an explanatory view of the second overlapping unit 600 of the apparatus 1000 for manufacturing the transformer core in FIG. 3.

FIG. 5 illustrates the block-shaped laminates $\mathbf{10}_A$, $\mathbf{10}_B$, $\mathbf{10}_C$ each formed by the displacement adjusting unit 500 as shown in FIG. 4(*c*). The block-shaped laminate $\mathbf{10}_C$ is the longest, $\mathbf{10}_A$ is the shortest, and the length of $\mathbf{10}_B$ is between those of $\mathbf{10}_C$ and $\mathbf{10}_A$. The second overlapping unit 600 laminates the plural block-shaped laminates $\mathbf{10}_A$, $\mathbf{10}_B$, $\mathbf{10}_C$ each having the displacement amount adjusted in the order of length. A reference numeral 10 denotes a laminate formed by sequentially laminating the block-shaped laminates $\mathbf{10}_A$, $\mathbf{10}_B$, $\mathbf{10}_C$ in the order of length. The displacement amounts of the block-shaped laminates $\mathbf{10}_A$, $\mathbf{10}_B$, $\mathbf{10}_C$ of the laminate 10 in the +/−X-axis direction correspond to the value to be set such that the abutting or overlapped portions of both ends of the respective amorphous metals upon annulation of the laminate 10 are located at circumferentially different positions between the adjoining amorphous metal layers.

The components described referring to FIG. 5 will be designated with the same reference numerals of FIG. 5.

FIG. 6 is an explanatory view of the annulation unit 700 of the apparatus 1000 for manufacturing the transformer core shown in FIG. 3.

Referring to FIG. 6, a reference numeral 701 denotes a winding core around which the laminate 10 is wound. In the annulation unit 700, the laminate 10 formed by laminating the plural block-shaped laminates $\mathbf{10}_A$, $\mathbf{10}_B$, $\mathbf{10}_C$ is wound around the winding core 701 such that the longer block-shaped laminate $\mathbf{10}_C$ is located on the outer circumference, and the shorter block-shaped laminate $\mathbf{10}_A$ is located on the inner circumference. Both end portions of the respective amorphous metals are abutted or overlapped, and the abutting or overlapped portion are located at circumferentially different positions between the adjoining amorphous metal layers for forming the annular structure. Specifically, in the annulation state, the abutting or overlapped portions of both end portions of the amorphous metal are located at circumferentially different positions between the adjoining amorphous metal layers in the joint portion $\mathbf{20}_A$ of the block-shaped laminate $\mathbf{10}_A$, which applies to the block-shaped laminates $\mathbf{10}_B$ and $\mathbf{10}_C$. The abutting or overlapped portions of both end portions of the amorphous metal are located at circumferentially different positions between the adjoining amorphous metal layers in each case of the block-shaped laminates $\mathbf{10}_A$, $\mathbf{10}_B$, $\mathbf{10}_C$.

FIG. 7 illustrates another exemplary structure of the apparatus for manufacturing the transformer core according to the present invention. In the exemplary structure, each plane surface of the plural thin magnetic materials (amorphous metals) drawn from the plural winding bodies are made parallel with one another.

Referring to FIG. 7, a reference numeral 1000' denotes an apparatus for manufacturing the transformer core, 100' denotes a winding body support portion as support means for supporting the plural winding bodies, each having the amorphous metal as the thin magnetic material with thickness of approximately 25 μm wound into hoop, 150*a* to 150*d* denote winding bodies, around of which the thin amorphous metals each with thickness of approximately $25\times10^{-3}$ m is wound into hoop, 102*a* to 102*d* denote reel portions for rotatably supporting the winding bodies 150*a* to 150*d*, 180' denotes a roller which abuts on the drawn amorphous metals 11*a* to 11*d* for applying predetermined tensional force thereto, 200' denotes cutting means which substantially simultaneously cuts the drawn plural amorphous metals 11*a* to 11*d* at the predetermined positions, respectively to form plural strip-shaped amorphous metals each with different length, 202*a* to 202*d* denote cutter portions which cut the amorphous metals 11*a* to 11*d* in the cutting means 200' to be strip-shaped, 300' denotes a drawing unit as drawing means for drawing the respective amorphous metals 11*a* to 11*d* each by a predetermined length, 301*a*' to 301*d*' denote grip portions which grip leading ends of the amorphous metals 11*a* to 11*d*, respectively in the drawing unit 300', 400' denotes a first overlapping unit as first overlapping means which forms the block-shaped laminate by laminating (overlapping) the thus cut plural amorphous metals 10*a* to 10*c* in the order of length in the state where one end surfaces (leading end surface or rear end surface) are aligned in the longitudinal direction, and the other end surfaces (rear end surface of leading end surface) are displaced with one another, or in the state where both end surfaces (leading end surface or rear end surface) are displaced with one another. A reference numeral 500 denotes a displacement adjusting unit as displacement adjusting means which adjusts the relative displacement amounts among the plural amorphous metals in the thus formed block-shaped laminate, that is, each displacement amount of the positions of the leading and the rear end surfaces of the amorphous metal to a preset amount, 600 denotes a second overlapping unit as second overlapping means which laminates the plural block-shaped laminates each having the displacement amount adjusted in the order of length, 700 denotes an annulation unit as annulation means for forming the annular structure by winding the laminate formed by laminating the plural block-shaped laminates around the winding core such that the longer block-shaped laminate is located on the outer circumferential side, and the shorter block-shaped laminate is located on the inner circumferential side, abutting or overlapping both end portions of the respective amorphous metals such that the abutting or overlapped portions are located at circumferentially different positions between the adjoining amorphous metal layers, 900' denotes a control unit for controlling the winding body support portion 100', the cutting means 200', the drawing unit 300', the first overlapping unit 400', the displacement adjusting unit 500, and the second overlapping unit 600, respectively.

Referring to FIG. 7, the first overlapping unit 400' laminates the strip-shaped amorphous metals 10*a* to 10*c* each cut into a different length in the order of length to form the block-shaped laminate in the state where one end surfaces are aligned in the longitudinal direction and the other end surfaces are displaced with one another, or in the state where both end surfaces are displaced in one another. The subsequent process steps are the same as those executed in the manufacturing apparatus 1000.

The technology as the embodiment of the present invention makes it possible to suppress fluctuation in the magnetic circuit property and dimension, and improve productivity of the transformer core with laminated structure. This also enables the low-cost production of the transformer core.

In the aforementioned embodiment, the block-shaped laminate $\mathbf{10}_A$ is formed of five amorphous metals 10*a* to 10*e* each with different length. However, the present invention is not limited to the aforementioned structure. More amorphous metals each with different length may be used for forming the block-shaped laminate $\mathbf{10}_A$, which applies to the block-shaped laminates $\mathbf{10}_B$ and $\mathbf{10}_C$. In the embodiment, the laminate 10 is formed of the block-shaped laminates $\mathbf{10}_A$, $\mathbf{10}_B$ and $\mathbf{10}_C$. However, the laminate 10 may be formed of more block-shaped laminates.

The invention which relates to cutting of the core material to be performed with the apparatus and method for manufacturing the core will be described referring to the drawings.

Figure 8:
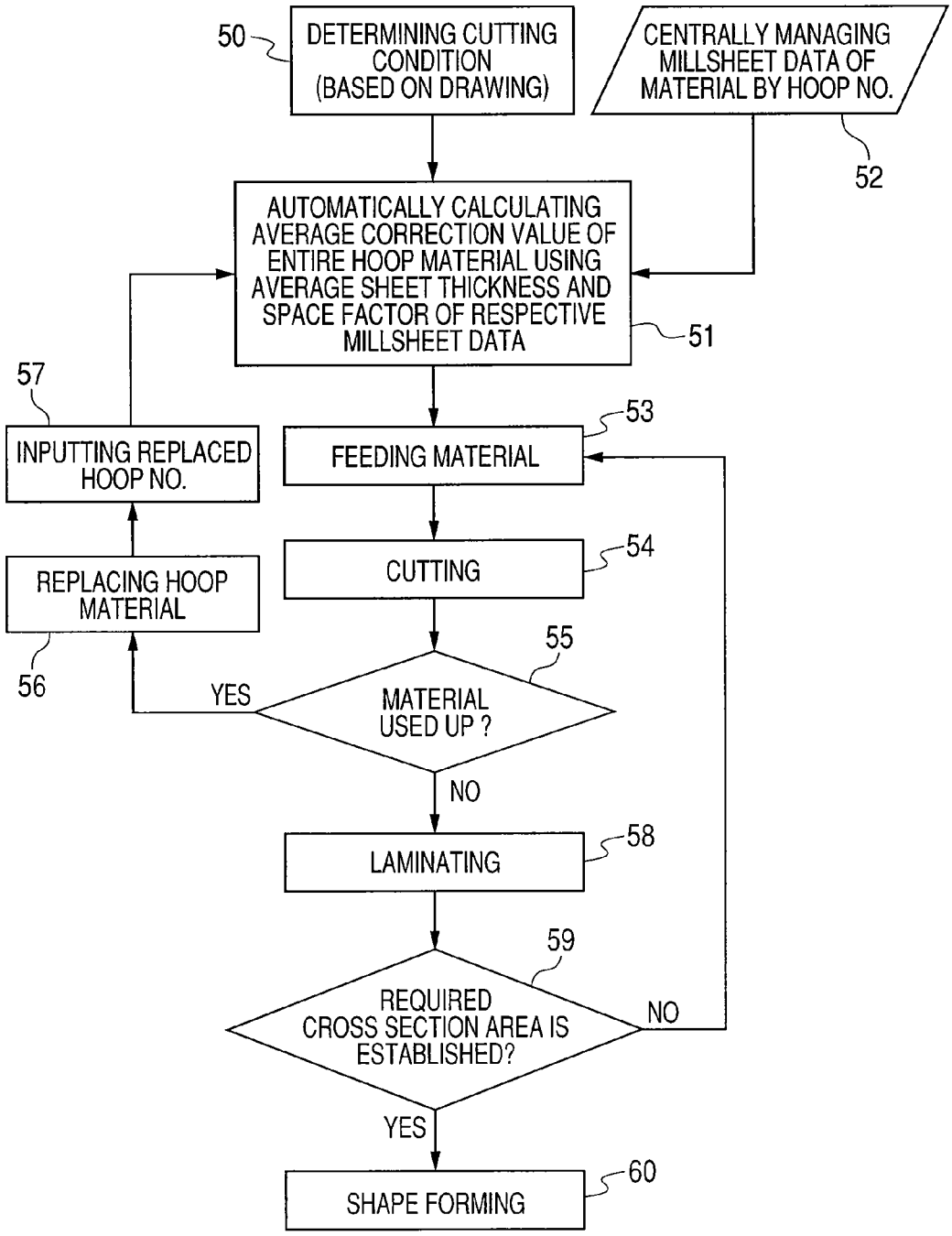
FIG. 8 is a flowchart of the process for cutting and shape forming when using a millsheet (score sheet) of the core material for the apparatus for manufacturing the transformer core according to the present invention.
Figure 9:
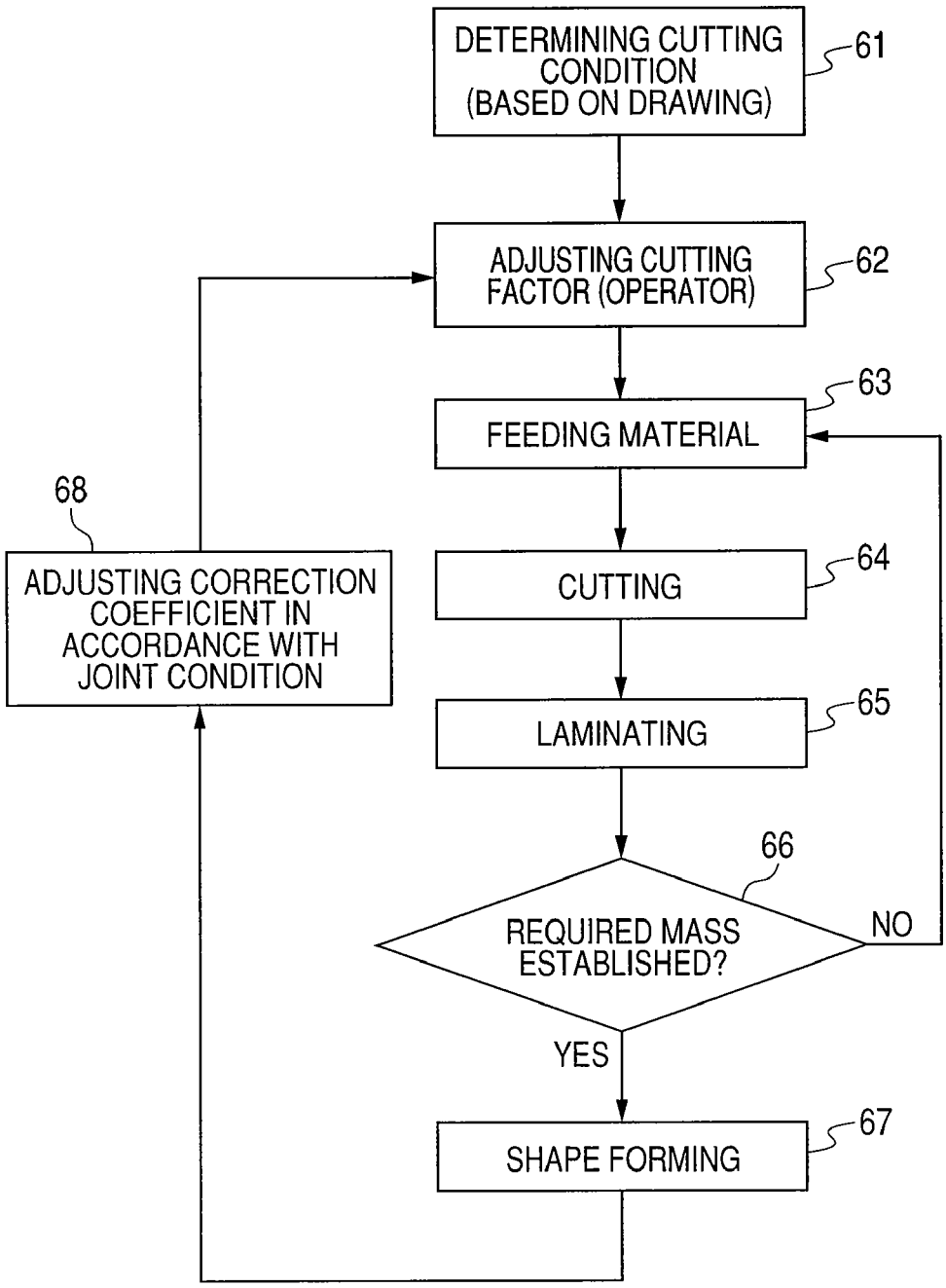
FIG. 9 is a flowchart of the process for determining the cutting length of the transformer core material in the generally employed apparatus for manufacturing the transformer core.
Figure 10:
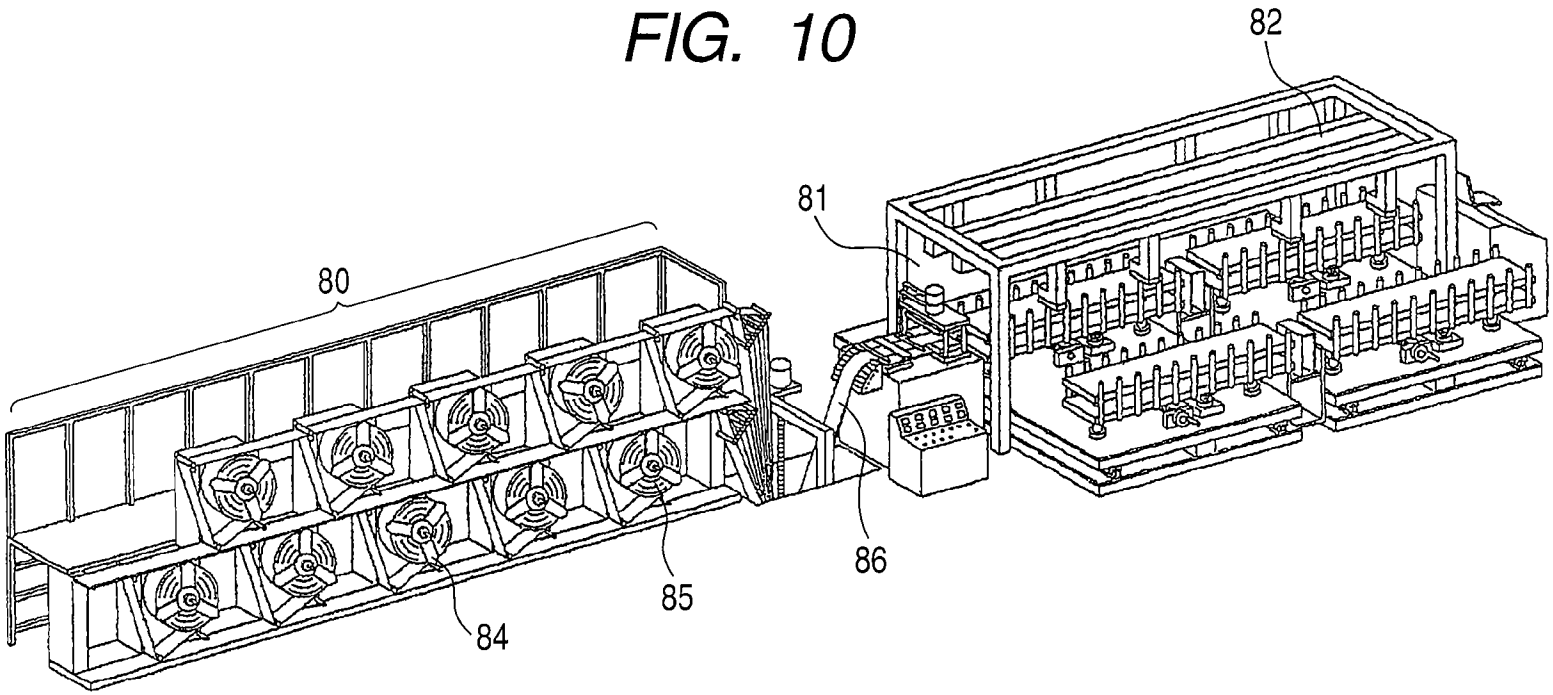
FIG. 10 illustrates an outer appearance of a cutting device of draw type for cutting the drawn core materials in the apparatus for manufacturing the transformer core according to the present invention.
Figure 11:
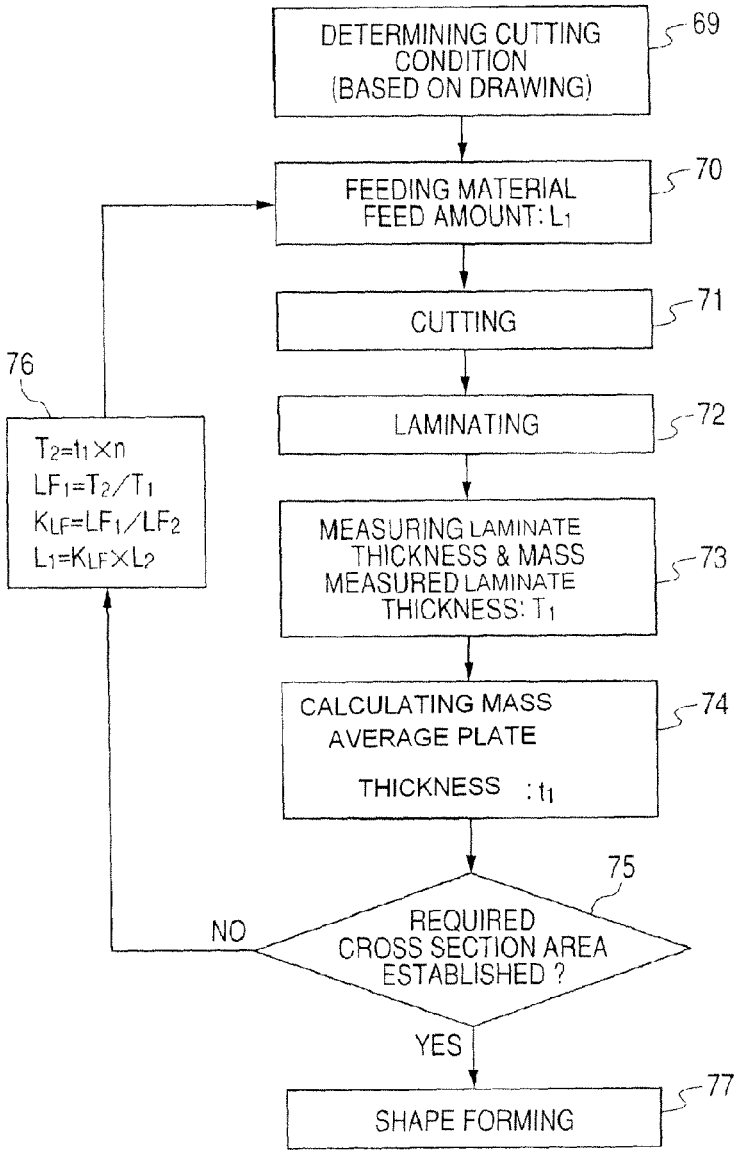
FIG. 11 is a flowchart of the process for determining the cutting length of the core material in the apparatus for manufacturing the transformer core according to the present invention.
Figure 12:
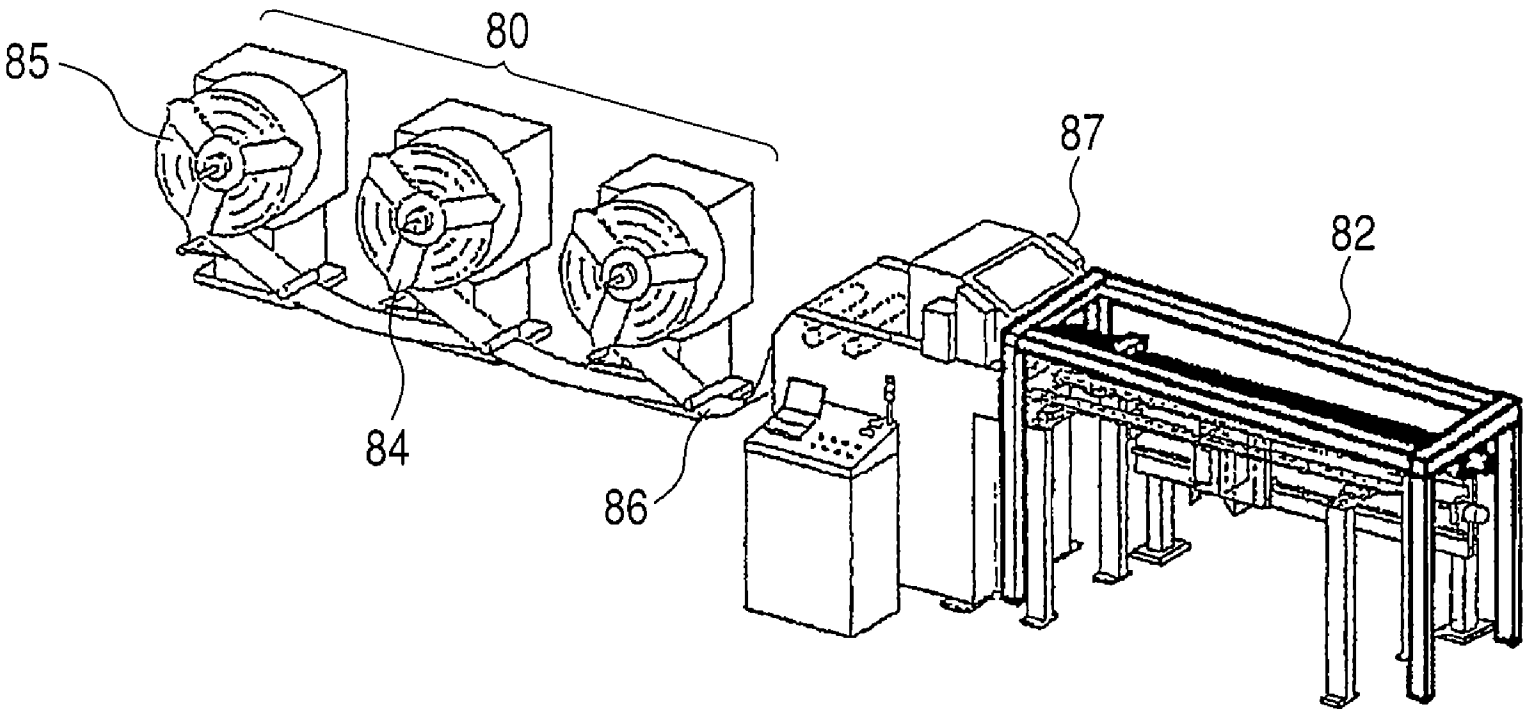
FIG. 12 illustrates an outer appearance of a cutting device of feed type for cutting the fed core material in the apparatus for manufacturing the transformer core according to the present invention.
Figure 13:
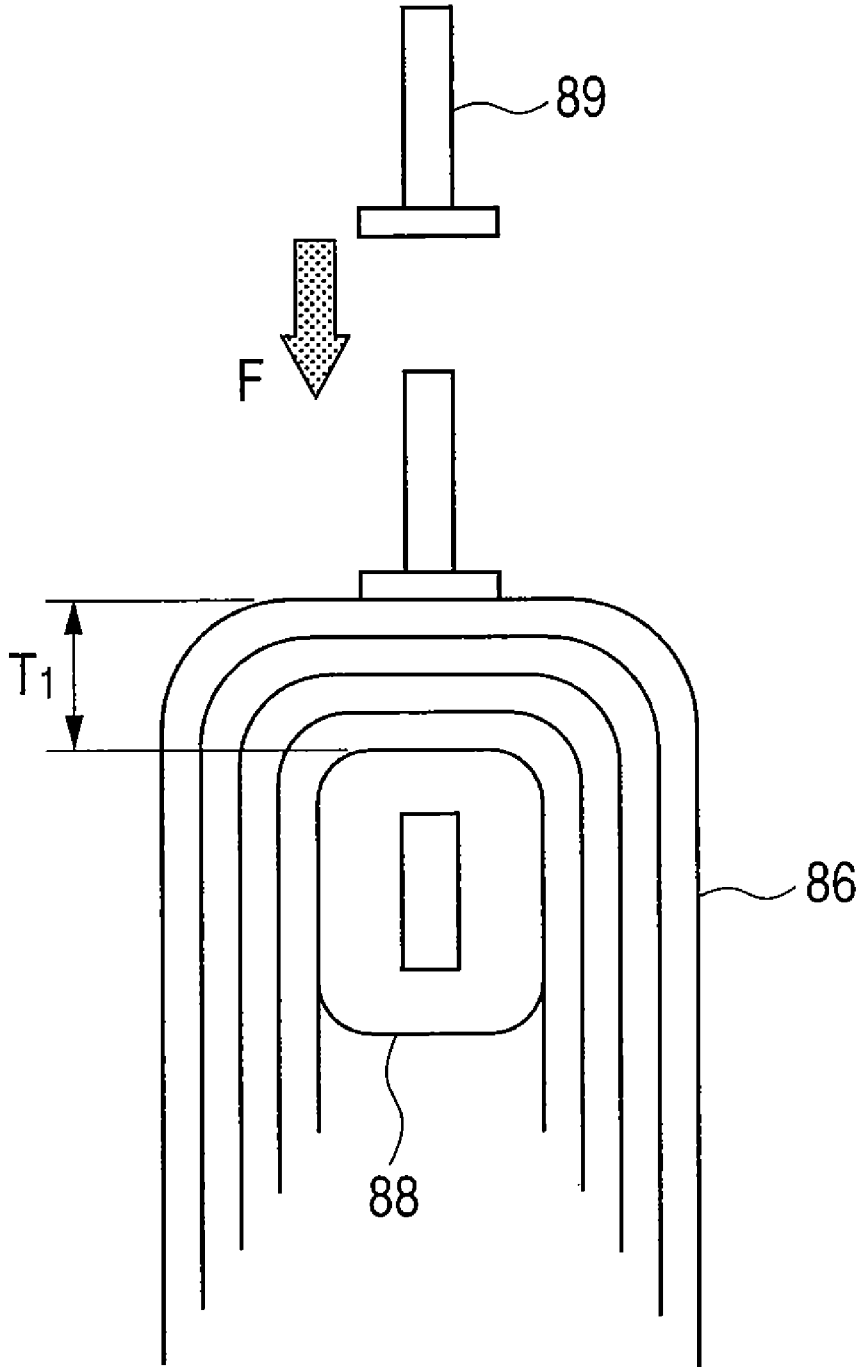
FIG. 13 schematically illustrates a laminate thickness measurement device for measuring the laminate thickness of the core material in the apparatus for manufacturing the transformer core according to the present invention.
Figure 14:
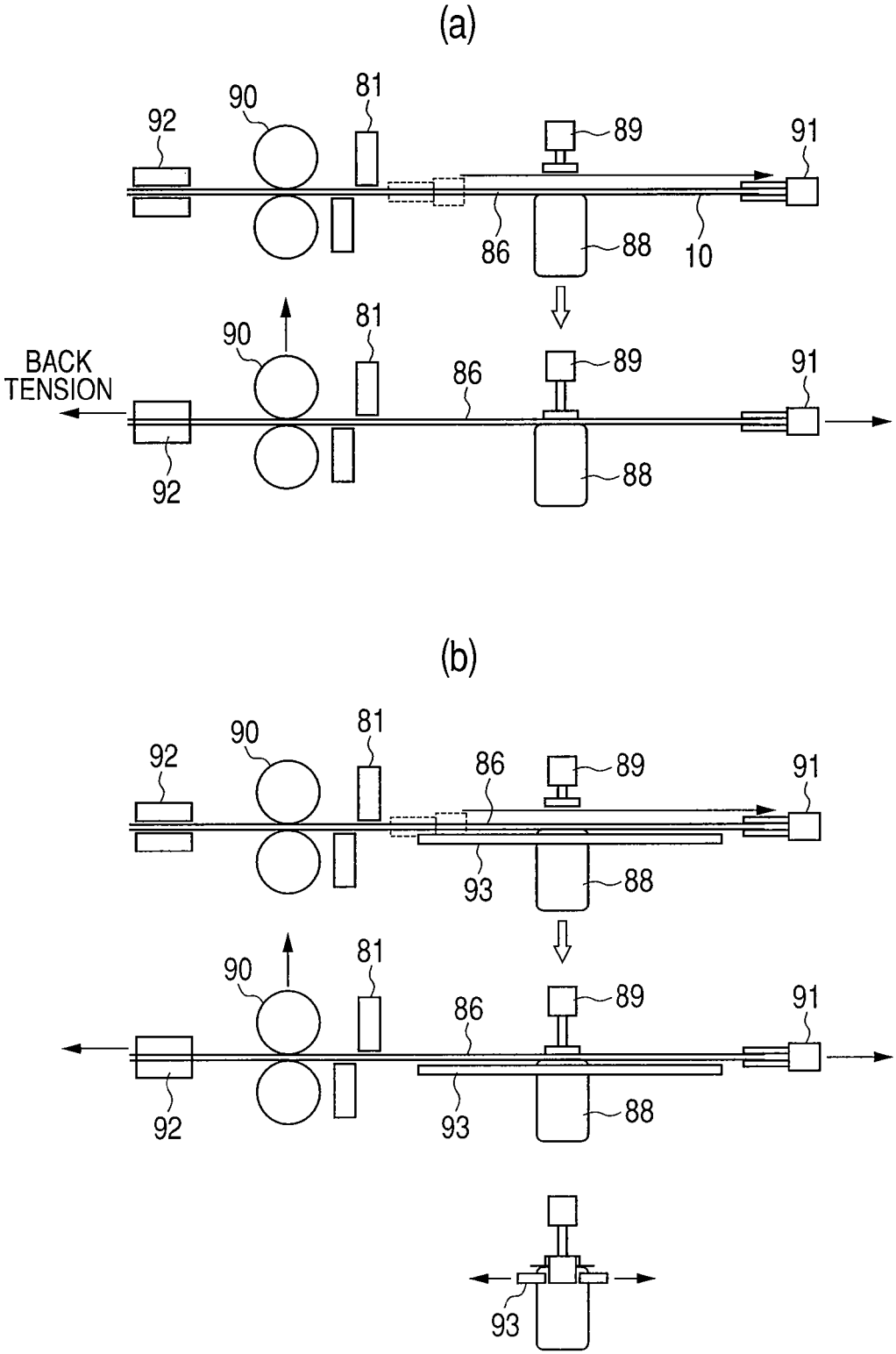
FIG. 14 schematically illustrates a laminate thickness measurement device for measuring the laminate thickness of the core material just before cutting in the apparatus for manufacturing the transformer core.
Figure 15:
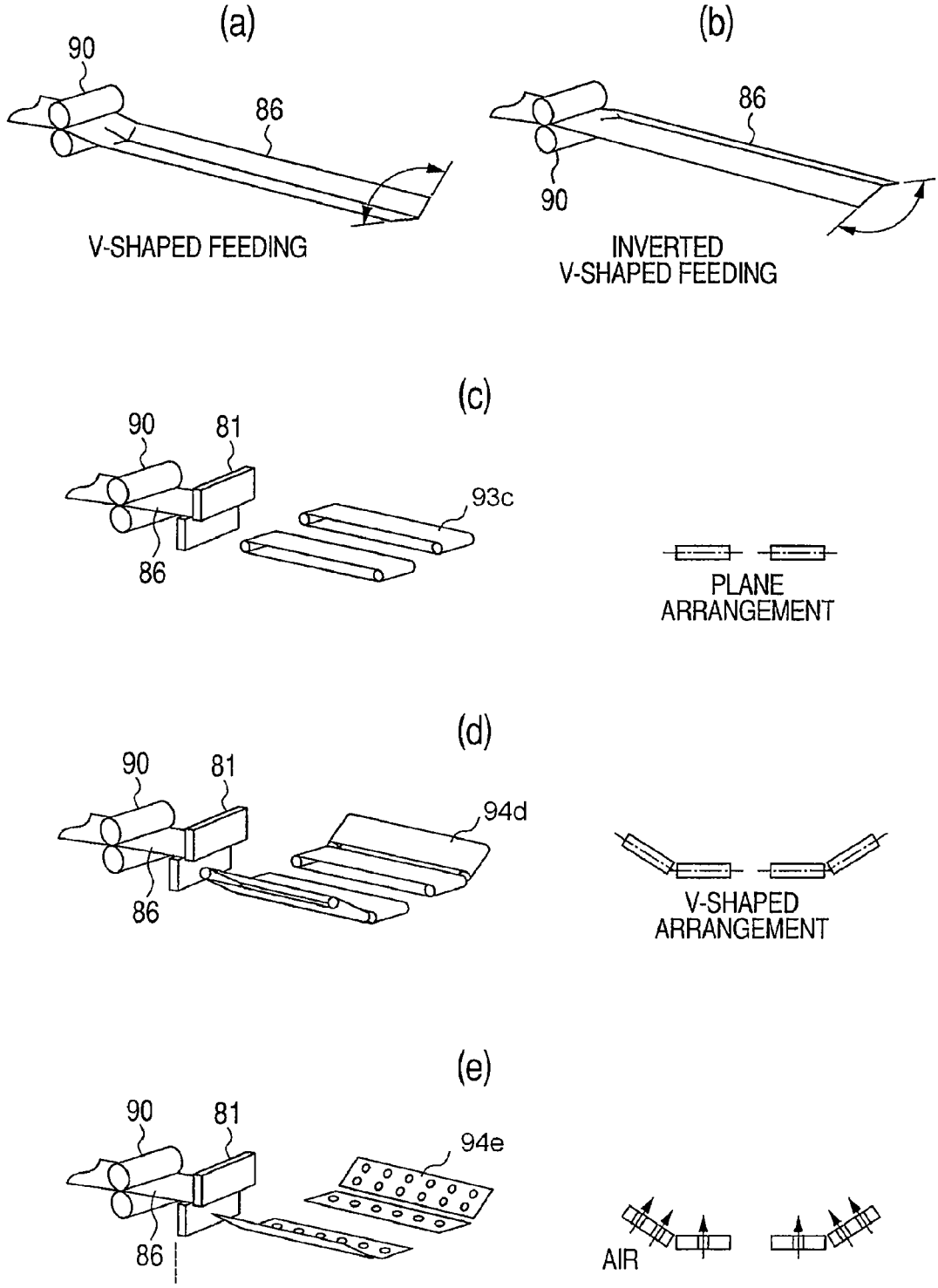
FIG. 15 schematically illustrates the feeder device for feeding the core material in the apparatus for manufacturing the transformer core according to the present invention.
Figure 16:
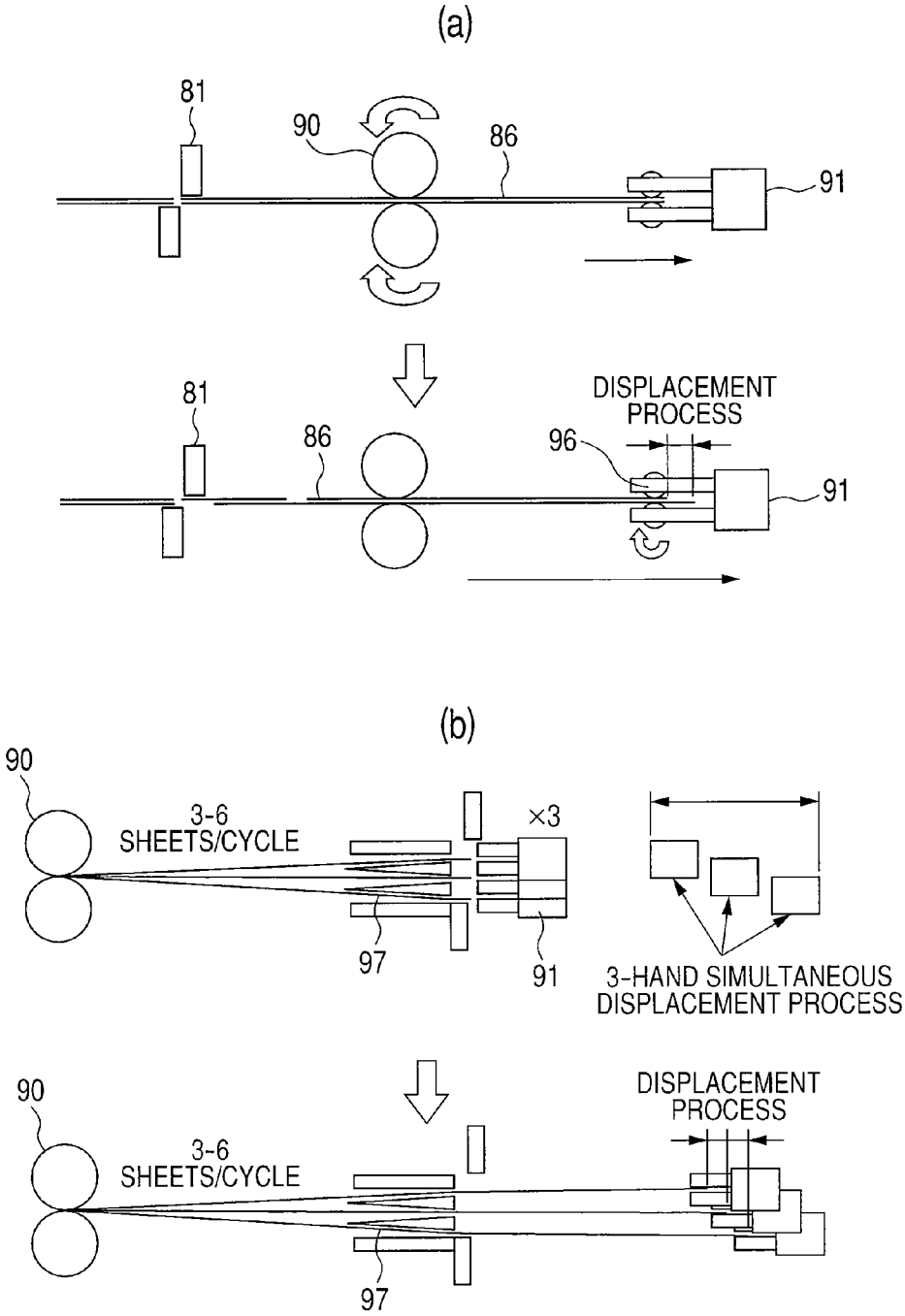
FIG. 16 is an explanatory view of the technology for displacing the cutting length of the core material in the apparatus for manufacturing the transformer core according to the present invention.

FIGS. 8 to 16 are explanatory views with respect to cutting of the core material performed in the apparatus for manufacturing the transformer core according to the present invention. FIG. 8 is a flowchart of the process for cutting and shape forming when using the millsheet (score sheet) of the core material for the apparatus for manufacturing the transformer core according to the present invention. FIG. 9 is a flowchart of the process for determining the cutting length of the core material in the generally employed manufacturing apparatus of the transformer core. FIG. 10 shows an outer appearance of the cutting device of drawing type for cutting the drawn core material in the apparatus for manufacturing the transformer core according to the present invention. FIG. 11 is a flowchart of the process for determining the cutting length of the core material in the apparatus for manufacturing the transformer core according to the present invention. FIG. 12 shows an outer appearance of the cutting device of feed type for cutting the fed core material in the apparatus for manufacturing the transformer core according to the present invention. FIG. 13 schematically shows a laminate thickness measurement device for measuring the laminate thickness of the core material in the apparatus for manufacturing the transformer core according to the present invention. FIG. 14 is a view schematically showing the laminate thickness measurement device for measuring the laminate thickness of the core material just before cutting in the apparatus for manufacturing the transformer core according to the present invention. FIG. 15 is a view schematically showing a feeder device for feeding the core material in the apparatus for manufacturing the transformer core according to the present invention. FIG. 16 is an explanatory view of the technology for displacing the cutting length of the core material in the apparatus for manufacturing the transformer core according to the present invention.

Referring to FIG. 8, the process starts by determining a cutting condition of the core material (step 50). Firstly, the material is cut into the cutting length based on the dimension derived from the design drawing. However, the length varies depending on the material (difference in the space factor owing to fluctuation of the plate thickness), and accordingly, such length is not always optimum. The optimum length keeps the defined length of the abutting portion of the material upon execution of the lap operation under the appropriate force.

In step 51, the average correction value of feed amount of the entire hoop material (formed by winding the thin core material around the reel) is automatically calculated using the mass average thickness (to be described later) of the millsheet data for the core material, and the space factor (proportion of the core (magnetic material) to the certain volume (area in this case)).

The millsheet data with respect to the respective materials are centrally managed for each hoop number (step 52), and the resultant data are used.

The average correction value of the material feed amount is calculated to determine the feed amount, based on which the material is fed (step 53).

After the material has been fed, it is cut (step 54). It is determined whether the hoop material has been used up (step 55).

When the material is used up, the hoop material is replaced (step 56), and the number of the replaced hoop is input (step 57). The process returns to step 51 for automatically calculating the average correction value of the amount for feeding the entire hoop material, and the loop is repeatedly executed.

When the material has not been used up, it is laminated. It is then determined whether the cross-section area of the core formed by laminating the material has reached the predetermined value (step 59). If the cross-section area of the core has not reached the predetermined value, the process returns to step 53 for feeding the material, and the loop is repeatedly executed.

If the cross-section area of the core has reached the predetermined value, the process proceeds to the next shape forming step.

Conventionally, the cross-section area of the core is obtained by applying the force in the laminating direction of the core, measuring the thickness, multiplying the measured thickness by the standard space factor, and further multiplying the resultant value by the plate width of the material. Alternatively, the designed mass is calculated by obtaining the core volume, and multiplying the volume by the space factor. If the core has reached the calculated mass, it is determined that the designed cross-section area has been established. It is assumed that the space factor is kept constant in the aforementioned methods. Actually, however, the space factor fluctuates depending on the plate thickness. It is therefore questionable to apply those methods to the amorphous metal.

Meanwhile, in the present invention, the plate thickness of the millsheet is considered as the representative value of the material plate thickness. The number of laminated materials is multiplied by the material width to directly obtain the cross-section area. This makes it possible to equally manage the cross-section area of the core which crosses the wiring, and further to manufacture the core with higher accuracy.

FIG. 9 shows a flowchart of the process for determining the cutting length of the core material in the generally employed manufacturing apparatus of the transformer core. Basically, the cross-section area is obtained based on the aforementioned concept as described above.

The plate thickness of the material and the space factor are fixed as the condition for cutting the core material. It is determined whether the cutting length is appropriate upon operation of the joint portion to be performed by the operator, and then the correction coefficient is used for the feedback for the next manufacturing so as to be adjusted.

Referring to the flowchart shown in FIG. 9, the cutting length as the cutting condition of the core material is set according to the design drawing. If adjustment of the thus set length is required to be adjusted, the adjustment is executed by the operator. If the adjustment is not required, the process is executed with the design dimension (step 61) to proceed to the step for feeding the material (step 63).

The fed material is cut (step 64) and laminated (step 65). It is then determined whether the laminated core has established the required predetermined mass (step 66).

If the predetermined mass has not been reached, the process returns to the step for feeding the material (step 63), and the process is repeatedly executed until the predetermined mass is reached.

If the predetermined amount of the material has been reached, the process proceeds to the shape forming step for forming the core into a U-like shape (step 67). After forming the core, the cutting length of the material is corrected in accordance with the lap state, that is, the state of the joint portion (step 68).

Conventionally, the operator adjusts the cutting length in accordance with the joint state after shape forming. It is not clear whether the method is capable of establishing the cross-section area intended by the designer.

FIG. 10 illustrates the cutting device of draw type for drawing the amorphous metal as the core material as a former stage of the apparatus for manufacturing the core.

The core is formed by laminating plural thin amorphous strips for the purpose of reducing variation in the magnetic property. The number of the amorphous metals may be appropriately in the range from 5 to 20. Generally, approximately 10 amorphous metals may be used. FIG. 10 illustrates a material stacking portion 82 formed of a uncoiler device 80, a cutting device 81, and a material stacking portion 82 on which the material is stacked in the amorphous core manufacturing device. The rectangular forming device and annealing device are provided subsequent to the material stacking portion 82.

The uncoiler device 80 unreels amorphous metal 85 wound around a series of five reels 84 in two stages, and laminates the amorphous thin strips in the upper and the lower stages to form the sheet material 86 formed by laminating ten sheets. The appropriate tensional force is applied to the sheet material 86 to take up the slack. Then the sheet material is fed to the cutting device 81.

The cutting device 81 cuts the thin strip-shaped amorphous metal 86 under the appropriate cutting conditions in accordance with the flow of the cutting condition as described referring to FIG. 8.

The cutting device 81 grips the sheet material 86 with a hand mechanism so as to be cut while keeping the appropriate tensional force. The cut sheet material 86 is fed to the material stacking portion 82 as the subsequent step.

FIG. 11 is a flowchart of the process for determining the cutting condition for cutting the material for forming the core representing a second embodiment.

The cutting length of the material is derived from the design drawing likewise the case shown in FIG. 8 to set the initial material cutting length (step 69). Then the material is fed only by the feed amount $L_1$ (step 70), and cut (step 71). The thus cut materials are laminated (step 72). The thickness of the laminated material is measured (hereinafter referred to as the measured laminate thickness $T_1$). The mass (M) of the material is measured (step 73), and the laminate thickness and mass of the material are measured to calculate the mass average laminate plate thickness $t_1$ (step 74).

The mass average plate thickness $t_1$ will be described. The cutting device is designed to finish cutting when the mass reaches the predetermined value (weight of a single piece of the core). The cut mass is obtained by multiplying the value derived from cutting length ($L_1$)×number of laminated sheets x material width×specific gravity of material by the plate thickness (mass average plate thickness $t_1$).

The above defined mass average plate thickness $t_1$ may be obtained from the aforementioned equation using values of the cutting length $L_1$ and the cut mass M are designated, the material width and the specific gravity of the material as fixed values, and the number of laminated sheets given as the number of laminated material.

After calculating the mass average plate thickness $t_1$, it is determined whether the cross-section area of the core has reached the predetermined value (step 75). If the cross-section area of the core has not reached the predetermined value, the calculation in step 76 is executed to obtain a correction feed amount $L_1$ of the material.

$$\text{Effective laminate thickness } T_2 = \text{mass average plate thickness } t_1 \times \text{number of laminated sheets } n \quad (1)$$

$$\text{Effective space factor } LF_1 = \text{effective laminate thickness } T_2 / \text{measured laminate thickness } T_1 \quad (2)$$

$$\text{Correction coefficient } K_{LF} = \text{effective space factor } LF_1 / \text{standard space factor } LF_2 \quad (3)$$

$$\text{Correction feed amount } L_1 = \text{correction coefficient } K_{LF} \times \text{reference feed amount } L_2 \quad (4)$$

As described above, the space factor is a proportion of the core (magnetic material) to a certain volume. The standard space factor is defined as the design value.

In the case where the cross-section area of the core (magnetic material) is required for designing the transformer, and the material thickness is constant, the thickness of the actually laminated materials is an important factor. The effective laminate thickness denotes the thickness of only the magnetic material.

The effective space factor denotes an actual value obtained by dividing the effective laminate thickness by the measured laminate thickness.

The correction coefficient will further be described. The value of lap margin upon the lapping operation varies with change in the space factor of the material. In the case where the cutting is performed in accordance with the normal value, if the space factor is low, the lap margin is reduced. The correction coefficient may be used for adjusting fluctuation of the aforementioned lap margin upon cutting. The lap margin is the most important factor upon cutting as its change influences the property.

The correction feed amount is a design value, based on which the material is cut.

Referring to FIG. 11, when the correction coefficient is obtained by the aforementioned equation, the process returns to step 70 for feeding the material so as to be repeatedly executed until the predetermined cross-section area is reached.

When the cross-section area of the laminate of the cut materials reaches the predetermined value, the process proceeds to the shape forming step (step 77).

FIG. 12 illustrates a cutting device of feed type for feeding the core material as a part of the apparatus for manufacturing the core. The structure of the device will be described hereinafter.

Referring to FIG. 12, a reference numeral 80 denotes the uncoiler device for unreeling the amorphous metal 85 from three consecutive reels 84 in the single stage which is wound therearound. In this example, five amorphous metals are laminated and wound around the consecutive reels. The amorphous metals formed by laminating five sheets are unreeled from the uncoiler device 80 to provide a sheet material 86 formed by laminating 15 sheets. The sheet material 86 is passed through the rollers to take up the slack. The resultant sheet material is fed and cut by the cutting device. A reference numeral 87 denotes a cutting/feeding device which combines functions for feeding and cutting the material. The material cut by the cutting/feeding device is fed to the material stacking portion 82 where the material sheets for forming the single piece of the core is stacked, and sent to the subsequent step which is not described.

FIG. 13 schematically illustrates the method for measuring the laminate thickness of the core material as described referring to the flowchart of FIG. 11.

Referring to FIG. 13, the reference numeral 86 denotes the amorphous metal which is laminated and U-like shaped around a cored bar 88 of the core. A laminate thickness measurement cylinder 89 is pushed against one side of the core so as to measure the thickness $T_1$ of the core.

FIG. 14 schematically represents measurement of the laminated material layer just before cutting the core material. Referring to FIG. 14(*a*), a reference numeral 90 denotes a feeder device for supplying the core material, 81 denotes the cutting device, 88 denotes the cored bar of the core, 89 denotes the laminate thickness measurement cylinder, and 91 denotes a hand mechanism as the material drawing device.

The upper drawing of FIG. 14(*a*) shows that the material is supplied to the feeder device 90 formed of feed rollers, and the material (amorphous metal 86) is drawn by the material drawing device 91 with the hand mechanism from the position indicated by dashed line to the one indicated by solid line.

The lower drawing of FIG. 14(*a*) shows that the feed rollers are moved away from the material 86 in the aforementioned state, a mechanism 92 for gripping and pulling the material is disposed opposite the material drawing device 91 such that the material is pulled by the material grip mechanism 92 and the material drawing device 91, and the material is cut by the cutting device 81 while keeping the tensional force. After cutting, the laminate thickness measurement cylinder 89 positioned above is lowered to push the material placed on the cored bar 88 of the core for measuring the laminate thickness of the material. The material is subjected to the measurement under the back tension for improving accuracy in measurement of the laminate thickness of the material.

FIG. 14(*b*) shows the same method for measuring the laminate thickness of the core except a guide 93 mounted below the material for allowing the measurement to be easily performed.

FIG. 15 schematically shows the feeder device for feeding the material. FIG. 15(*a*) feeds the material (amorphous metal 86) fed through the feed rollers of the feeder device 90 while being formed into the V-like shape in the longitudinal direction. The material is formed into the V-like shape by passing and feeding the material along the V-like guide therebelow.

The plate-like material fed from the hoop material is formed into the V-like shape to render strength. The material may be linearly fed for further improving workability.

As an embodiment different from FIG. 15(*a*), FIG. 15(*b*) shows the structure which deforms the material in the inverted V-like shape in the longitudinal direction of the material so as to be fed. The inverted V-like shaped guide is mounted below the material (not shown), and the material is passed and fed along the guide as the inverted V-like shape material. The aforementioned structure provides the same effect as those derived from the structure shown in FIG. 15(*a*).

FIGS. 15(*c*) to 15(*e*) show a tray used for feeding the material. FIG. 15(*c*) shows the structure formed by arranging two planar belt conveyor type trays 94*c* in parallel. The material (amorphous metal 86) is fed on the trays 94*c* which are arranged in parallel having a gap therebetween.

FIG. 15(*d*) shows the structure where two planar belt conveyor type trays 94*d* in two lines are ramped so as to prevent deviation of the fed material from the feeding line.

FIG. 15(*e*) shows the structure where two planer trays 94*e* in two lines are ramped so as to prevent deviation of the fed material from the feeding line, in which each tray 94*e* is made flat and has a large number of holes, through which air is blown from below. This structure is capable of feeding the material while being kept spaced above the bottom. The present invention provides the effect for preventing damage to the material.

FIG. 16 illustrates a structure of the device with the mechanism for feeding the material, which displaces the cutting length of the material.

Referring to FIG. 16, the reference numeral 81 denotes the cutting device, 90 denotes the feeding device (feed rollers), 91 denotes the material drawing device (hand mechanism), 86 denotes the material (amorphous metal), 96 denotes the feed roller with hand mechanism, and 97 denotes a separator with slit shape.

Referring to FIG. 16(*a*), the material 86 is fed by the feed rollers 90, and each rotating speed of the upper and lower sections of the feed rollers 96 attached to the hand mechanism of the material drawing device are made different with respect to the material 86. For example, if the lower roller is rotated while keeping the upper roller non-rotational, the laminated material on the lower side may only be fed, thus displacing the material sheets. The displacement amount of the material may be adjusted by controlling the rotation of the feed rollers as described above.

FIG. 16(*b*) shows the structure for drawing the material 86 fed from the feed rollers 96 using the hand mechanism 91 of the material drawing device via the separator 97 with the slit for cutting. The upper drawing of FIG. 16(*b*) shows the state where the material is divided by the separator 97, and the lower drawing shows the state where the separated materials are drawn by the hand mechanism 91 and displaced with one another.

The displaced state as described above improves workability upon lap operation.

INDUSTRIAL APPLICABILITY

By the above description of the invention, industrial applicability is promising.

DESCRIPTION OF CODES

1000, 1000' . . . apparatus for manufacturing a transformer core
2000 . . . transformer
1 . . . transformer core
2*a*, 2*b* . . . coil
10$_A$, 10$_B$, 10$_C$ . . . block-shaped laminate
10*a*-10*e*, 11*a*-11*d* . . . amorphous metal
20, 20$_A$ . . . joint portion
100,100' . . . winding body support portion
101*a*-101*d*, 102*a*-102*d* . . . reel portion
150*a*-150*d* . . . winding body
180,180' . . . roller
200,200' . . . cutting means
201*a*-201*d*, 202*a*-202*d* . . . cutter portion
300,300' . . . drawing portion
301*a*-301*d*, 301*a*'-301*d*' . . . grip portion
302*a*-302*d* . . . driving portion
400,400' . . . first overlapping unit
500 . . . displacement adjusting unit
501$_A$ . . . end fixing portion
502$_{A1}$, 502$_{A2}$ . . . intermediate fixing portion
600 . . . second overlapping unit
700 . . . annulation unit
701 . . . winding core
800 . . . heat-treatment unit
900,900' . . . control unit
80 . . . uncoiler device
81 . . . cutting device
82 . . . material stacking portion
84 . . . cutting/feeder integrated unit
88 . . . cored bar of a core
89 . . . laminate thickness measurement cylinder
90 . . . feeder device (feed roller)
91 . . . material drawing device (hand mechanism)
93 . . . guide
85 . . . amorphous metal
94*c*, 94*d*, 94*e* . . . tray
96 . . . feed roller with hand mechanism
97 . . . separator

The invention claimed is:

1. An apparatus for manufacturing a transformer core with an annular shape formed by laminating magnetic sheet materials, the apparatus comprising:

a support means which supports each of a plurality of winding bodies of the magnetic sheet materials;

a drawing means which draws each of the magnetic sheet materials from the plurality of supported winding bodies by a predetermined length;

a cutting means which cuts the plurality of drawn magnetic sheet materials at predetermined set positions and provides a plurality of magnetic sheet materials each with a different length;

a first overlapping means which laminates the plurality of cut magnetic sheet materials and forms a block-shaped laminate;

a displacement adjusting means which adjusts a relative displacement amount of the plurality of laminated magnetic sheet materials to a predetermined amount;

a second overlapping means which laminates a plurality of adjusted displacement block-shaped laminates by order of length and forms a resultant laminate;

an annulation means which forms an annular structure of the resultant laminate as a transformer core in which a longer block-shaped laminate forms an outer annular portion, and a shorter block-shaped laminate forms an inner annular portion and both ends of the respective magnetic sheet materials are abutted or overlapped so that the abutted or the overlapped portions are located at annularly different positions between adjoining layers of the magnetic sheet materials; and a control unit which controls at least the drawing means, the cutting means, the first overlapping means and the displacement adjusting means.

2. An apparatus for manufacturing a transformer core with an annular shape formed by laminating magnetic sheet materials, the apparatus comprising:

a support means which supports each of a plurality of winding bodies of the magnetic sheet materials;

a drawing means which draws each of the magnetic sheet materials from the plurality of supported winding bodies by a predetermined length;

a cutting means which cuts the plurality of drawn magnetic sheet materials at predetermined set positions and provides a plurality of magnetic sheet materials each with a different length;

a first overlapping means which laminates the plurality of cut magnetic sheet materials and forms a block-shaped laminate in a state where first end surfaces of each magnetic sheet material are aligned in a longitudinal direction and second end surfaces of each magnetic sheet are displaced with one another, or in a state where both the first and second surfaces are displaced with one another;

a displacement adjusting means which includes:

an end fixing portion which pushes the first end surfaces of two outermost magnetic sheet materials of the block-shaped laminate and applies a compression force to the block-shaped laminate in a direction of lamination of the magnetic sheet materials and fixes the first end portions of the two outermost magnetic sheet materials of the block-shaped laminate, a bending portion which displaces the end fixing portion and bends the laminate at a predetermined curvature so that the longer magnetic sheet material is located on an outer curved portion and the shorter magnetic sheet material is located on an inner curved portion, and an intermediate fixing portion which applies a compression force to the block-shaped laminate at an intermediate portion in a longitudinal direction of the bent block-shaped laminate toward a direction of lamination of the magnetic sheet materials, and adjusts a relative displacement amount of the plural magnetic sheet materials in the block-shaped laminate to a predetermined amount by releasing the first end portion of the block-shaped laminate fixed by the end fixing portion, displacing the released first end fixing portion and reducing the curvature of the bent block-shaped laminate, while keeping the compression force applied to the block-shaped laminate by the intermediate fixing portion;

a second overlapping means which laminates a plurality of adjusted displacement block-shaped laminates and forms a resultant laminate;

an annulation means which forms an annular structure of the resultant laminate as a transformer core in which a longer block-shaped laminate forms an outer annular portion, and a shorter block-shaped laminate forms an inner annular portion and both ends of the respective magnetic sheet materials are abutted or overlapped so that the abutted or the overlapped portions are located at annularly different positions between adjoining layers of the magnetic sheet materials; and a control unit which controls at least the drawing means, the cutting means, the first overlapping means and the displacement adjusting means.

3. An apparatus for manufacturing a core formed of an amorphous metal sheet, the apparatus comprising:

a support means which supports each of a plurality of winding bodies of magnetic sheet materials;

a first calculating means which calculates an average correction value of a feeding length of the magnetic sheet materials and sets feeding length based on the calculated average correction value;

a feeding or drawing means which feeds or draws the magnetic sheet materials in a state of being laminated from the plurality of supported winding bodies in accordance with the set feeding length information;

a cutting means which cuts the fed or drawn magnetic sheet materials at predetermined set positions and provides a plurality of amorphous metal sheets each with a different length;

a laminating means which laminates the cut plural magnetic sheet materials and provides a laminate;

a measuring means which measures laminate thickness and mass of the laminate;

a second calculating means which:

calculates a mass average plate thickness based on the laminate thickness and mass of the laminate, calculates a cross-section area of the laminate based on the mass average plate thickness, and determines whether the cross-section area of the laminate has reached a predetermined value; and a shape forming means which forms an annular structure of the laminate as the core when the second calculating means determines that the cross-section area of the laminate reaches the predetermined value.

4. The apparatus according to claim 3, wherein:

when the second calculating means determines that the cross-section area of the laminate does not reach the predetermined value, the second calculating means:

calculates an effective laminate thickness of the laminate based on the mass average plate thickness, calculates an effective space factor of the laminate based on the effective laminate thickness, calculates a correction coefficient based the effective space factor, and calculates a correction feed amount of magnetic sheet material, and the calculated correction feed amount is feed backed to the first calculating means.

5. The apparatus according to claim 3, wherein the feeding or drawing means feeds or draws the laminated magnetic sheet materials in an angled state.

6. The apparatus according to claim 3, wherein the feeding or drawing means has a mechanism assisted by a tray with a belt conveyor for feeding or drawing the laminated magnetic sheet materials in an angled state.

7. The apparatus according to claim 3, wherein the feeding or drawing means has a mechanism assisted by a tray with air blow holes for feeding or drawing the laminated magnetic sheet materials in an angled state.

8. The apparatus according to claim 3, further comprising:

a cutting/shape forming portion of a winding core for a stationary device using an amorphous metal for forming the core, the cutting/shape forming portion configured for:

drawing and cutting plural laminated sheets from the amorphous metal set in a plurality of uncoiler devices, displacing a single sheet or a small number of sheets of the laminated sheets by a predetermined amount to improve magnetic properties and productivities, and displacing a single sheet or a small number of sheets of the fed or drawn magnetic sheet materials.

* * * * *